US010733864B2

(12) United States Patent
Uruno

(10) Patent No.: US 10,733,864 B2
(45) Date of Patent: Aug. 4, 2020

(54) INFORMATION PROCESSING DEVICE, INFORMING SYSTEM, INFORMATION PROCESSING METHOD, AND PROGRAM

(71) Applicant: Mitsubishi Electric Corporation, Tokyo (JP)

(72) Inventor: Hikaru Uruno, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/337,660

(22) PCT Filed: Nov. 1, 2016

(86) PCT No.: PCT/JP2016/082478
§ 371 (c)(1),
(2) Date: Mar. 28, 2019

(87) PCT Pub. No.: WO2018/083738
PCT Pub. Date: May 11, 2018

(65) Prior Publication Data

US 2019/0244507 A1 Aug. 8, 2019

(51) Int. Cl.
*G08B 23/00* (2006.01)
*G08B 21/02* (2006.01)
(Continued)

(52) U.S. Cl.
CPC ..... *G08B 21/02* (2013.01); *G08B 21/182* (2013.01); *G08B 25/04* (2013.01)

(58) Field of Classification Search
CPC ..... G08B 21/02; G08B 25/04; G08B 21/182; G08B 21/0461; G08B 21/043;
(Continued)

(56) References Cited

U.S. PATENT DOCUMENTS 6,289,237 B1 * 9/2001 Mickle ..... G06K 7/0008 600/509
6,753,782 B2 * 6/2004 Power ..... A61B 5/1124 340/573.4
(Continued)

FOREIGN PATENT DOCUMENTS

CN 105094009 A 11/2015
CN 105279898 A 1/2016
(Continued)

OTHER PUBLICATIONS

Office Action dated Oct. 29, 2019 issued in corresponding JP patent application No. 2018-548487 (and English translation).
(Continued)

*Primary Examiner* — Anh V La
(74) *Attorney, Agent, or Firm* — Posz Law Group, PLC

(57) ABSTRACT

An information processing device is equipped with a recognition information acquirer, a danger determiner, a signal generator, and a signal transmitter. The recognition information acquirer acquires, from an electric apparatus, recognition information that is information obtained as a result of recognition of sensor information by the electric apparatus that performs operational control using the sensor information, the sensor information being sensed and output by a sensor. The danger determiner determines whether a danger state exists based on the recognition information acquired by the recognition information acquirer. The signal generator, when the danger determiner determines that the danger state exists, generates an informing signal that causes operation of an informing function of an informing apparatus that informs of danger. The signal transmitter transmits to the informing apparatus the informing signal generated by the signal generator.

19 Claims, 28 Drawing Sheets

(51) Int. Cl.
*G08B 21/18* (2006.01)
*G08B 25/04* (2006.01)

(58) Field of Classification Search
CPC .. G08B 21/0275; G08B 3/10; G08B 21/0446; G07C 9/257; G07C 9/27; G07C 9/00571; G07C 9/00174; G06Q 20/3821; G09B 21/001; A61H 3/061; A61H 2201/5097; A61H 2201/5084; A61H 2201/5069; A61H 2201/5064; A61H 2201/5061; A61H 2201/5048; A61H 2201/5023; A61H 2201/165; A61H 3/068; A61H 3/00
USPC ... 340/573.1, 573.4, 539.13, 539.15, 539.11, 340/10.1
See application file for complete search history.

(56) References Cited

U.S. PATENT DOCUMENTS

| | | | | |
|---|---|---|---|---|
| 9,297,882 | B1 * | 3/2016 | Bhatia | H04W 4/21 |
| 2009/0021381 | A1 | 1/2009 | Kondo et al. | |
| 2013/0184592 | A1 * | 7/2013 | Venetianer | H04N 7/18 600/476 |
| 2015/0097663 | A1 * | 4/2015 | Sloo | G08B 25/002 340/501 |
| 2015/0145661 | A1 * | 5/2015 | Beggs | B60Q 1/2673 340/435 |
| 2015/0356837 | A1 | 12/2015 | Pajestka et al. | |
| 2017/0124833 | A1 | 5/2017 | Zhang et al. | |

FOREIGN PATENT DOCUMENTS

| | | | |
|---|---|---|---|
| EP | 2 292 986 | A2 | 3/2011 |
| JP | 2003-123192 | A | 4/2003 |
| JP | 3114539 | U | 10/2005 |
| JP | 2008-215953 | A | 9/2008 |
| JP | 2009-104564 | A | 5/2009 |
| JP | 2010-124391 | A | 6/2010 |
| JP | 2011-027305 | A | 2/2011 |
| JP | 2013-37600 | A | 2/2013 |
| JP | 2013-169221 | A | 9/2013 |
| JP | 2015-32125 | A | 2/2015 |
| JP | 2015-132406 | A | 7/2015 |
| JP | 2015-158846 | A | 9/2015 |
| JP | 2016-082515 | A | 5/2016 |
| KR | 10-1339398 | B1 | 8/2013 |
| WO | 2008/029724 | A1 | 3/2008 |

OTHER PUBLICATIONS

Extended European Search Report dated Nov. 4, 2019 issued in corresponding EP patent application No. 16920796.6.
Office Action dated Jan. 10, 2020 issued in corresponding AU patent application No. 2016428807.
Office Action dated Feb. 18, 2020 issued in corresponding JP patent application No. 2018-548487 (and English translation).
International Search Report of the International Searching Authority dated Dec. 13, 2016 for the corresponding international application No. PCT/JP2016/082478 (and English translation).
Office Action dated May 19, 2020 issued in corresponding CN patent application No. 201680090337.3 (and English translation).

* cited by examiner

FIG. 3

| SENSOR APPARATUS NAME | EFFECTIVE / INEFFECTIVE | COMMUNICATION I/F | IDENTIFICATION INFORMATION | TRANSMITTED RECOGNITION INFORMATION | ... |
|---|---|---|---|---|---|
| AIR CONDITIONER-1 | EFFECTIVE | LAN | MAC-2 | IMAGE RECOGNITION INFORMATION | ... |
| TELEVISION-1 | EFFECTIVE | LAN | MAC-1 | IMAGE RECOGNITION INFORMATION | ... |
| ... | ... | ... | ... | ... | ... |

SENSOR APPARATUS INFORMATION STORAGE

FIG. 4

| INFORMING APPARATUS NAME | EFFECTIVE / INEFFECTIVE | COMMUNICATION I/F | IDENTIFICATION INFORMATION | SIGNAL GENERATION INFORMATION | ... |
|---|---|---|---|---|---|
| SMART PHONE-1 | EFFECTIVE | LAN | ID-1 | PUSH COMMUNICATION | ... |
| MAIL TERMINAL-1 | INEFFECTIVE | LAN | MAIL-1 | ELECTRONIC MAIL | ... |
| TELEVISION-1 | EFFECTIVE | LAN | MAC-1 | IMAGE + AUDIO | ... |
| AUDIO DEVICE-1 | EFFECTIVE | Bluetooth | MAC-3 | AUDIO | ... |
| ... | ... | ... | ... | ... | ... |

INFORMING APPARATUS INFORMATION STORAGE

FIG. 5

| No. | INFORMING EVENT NAME | EFFECTIVE / INEFFECTIVE | DETERMINATION CONDITION | ... |
|---|---|---|---|---|
| 001 | APPROACHING OPENING | EFFECTIVE | "CHILD" IS PRESENT WITHIN 1 M FROM "OPENING" | ... |
| 002 | APPROACHING LEVEL DIFFERENCE | EFFECTIVE | "PERSON" IS PRESENT WITHIN 1 M FROM "LEVEL DIFFERENCE" | ... |
| ... | ... | ... | ... | ... |

INFORMING EVENT STORAGE

THERMAL IMAGE DATA

| CAPACITY (kW) | SURFACE AREA ($m^2$) | MINIMUM VALUE (m) | MAXIMUM VALUE (m) | CENTRAL VALUE (m) |
|---|---|---|---|---|
| 2.2 | 9.7 ~ 15 | 2.2 | 5.5 | 3.5 |
| 2.8 | 13 ~ 19 | 2.5 | 6.2 | 4.0 |
| ... | ... | ... | ... | ... |

RELATIONSHIP BETWEEN CAPACITY AND SIZE OF INSTALLATION ROOM

THERMAL IMAGE DATA

THERMAL IMAGE DATA

FIG. 18

| No. | INFORMING EVENT NAME | EFFECTIVE / INEFFECTIVE | DETERMINATION CONDITION | CONTROL CONTENT | ... |
|---|---|---|---|---|---|
| 001 | APPROACHING OPENING | EFFECTIVE | "CHILD" IS PRESENT WITHIN 1 M FROM "OPENING" | CLOSE ELECTRIC-DRIVEN SHUTTER INSTALLED AT "OPENING" | ... |
| 002 | APPROACHING LEVEL DIFFERENCE | EFFECTIVE | "PERSON" IS PRESENT WITHIN 1 M FROM "LEVEL DIFFERENCE" | INFORMING FROM INFORMING APPARATUS | ... |
| ... | ... | ... | ... | ... | ... |

INFORMING EVENT STORAGE

FIG. 20

| No. | INFORMING EVENT NAME | EFFECTIVE / INEFFECTIVE | RECORD DETERMINATION | DETERMINATION CONDITION | ... |
|---|---|---|---|---|---|
| 001 | APPROACHING OPENING | EFFECTIVE | – | "CHILD" IS PRESENT WITHIN 1 M FROM "OPENING" | ... |
| 002 | APPROACHING LEVEL DIFFERENCE | EFFECTIVE | – | "PERSON" IS PRESENT WITHIN 1 M FROM "LEVEL DIFFERENCE" | ... |
| 003 | FALL FROM OPENING | EFFECTIVE | 001 | "CHILD" IS PRESENTLY BEYOND "OPENING" | ... |
| 004 | FALL DOWN LEVEL DIFFERENCE | EFFECTIVE | 002 | "PERSON" IS PRESENTLY BELOW "LEVEL DIFFERENCE" | ... |
| ... | ... | ... | ... | ... | ... |

INFORMING EVENT STORAGE

FIG. 25

| SENSOR NAME | EFFECTIVE / INEFFECTIVE | COMMUNICATION I/F | IDENTIFICATION INFORMATION | SENSOR TYPE | ... |
|---|---|---|---|---|---|
| VISIBLE LIGHT CAMERA-1 | EFFECTIVE | LAN | MAC-4 | VISIBLE LIGHT CAMERA | ... |
| INFRARED CAMERA -1 | EFFECTIVE | LAN | MAC-5 | INFRARED CAMERA | ... |
| INFRARED RADIATION SENSOR-1 | EFFECTIVE | LAN | MAC-6 | THERMAPILE-TYPE INFRARED RADIATION SENSOR | ... |
| ... | ... | ... | ... | ... | ... |

SENSOR APPARATUS INFORMATION STORAGE

FIG. 26

| No. | NOTIFICATION EVENT NAME | EFFECTIVE / INEFFECTIVE | DETERMINATION CONDITION | ... |
|---|---|---|---|---|
| 001 | APPROACHING OPENING | EFFECTIVE | "CHILD" IS PRESENT WITHIN 1 M FROM "OPENING" | ... |
| 002 | APPROACHING LEVEL DIFFERENCE | EFFECTIVE | "PERSON" IS PRESENT WITHIN 1 M FROM "LEVEL DIFFERENCE" | ... |
| 003 | APPROACHING HIGH TEMPERATURE PART | EFFECTIVE | "PERSON" IS PRESENT WITHIN 1 M FROM "HIGH TEMPERATURE PART" | ... |
| ... | ... | ... | ... | ... |

INFORMING EVENT STORAGE

FIG. 30

| SENSOR APPARATUS NAME | EFFECTIVE / INEFFECTIVE | COMMUNICATION I/F | IDENTIFICATION INFORMATION | TRANSMITTED SENSOR INFORMATION | ... |
|---|---|---|---|---|---|
| AIR CONDITIONER-1 | EFFECTIVE | LAN | MAC-2 | IMAGE RECOGNITION INFORMATION | ... |
| TELEVISION-1 | EFFECTIVE | LAN | MAC-1 | INFRARED RADIATION SENSOR INFORMATION | ... |
| VISIBLE LIGHT CAMERA-1 | EFFECTIVE | LAN | MAC-4 | VISIBLE LIGHT CAMERA INFORMATION | ... |
| ... | ... | ... | ... | ... | ... |

SENSOR APPARATUS INFORMATION STORAGE

INFORMATION PROCESSING DEVICE, INFORMING SYSTEM, INFORMATION PROCESSING METHOD, AND PROGRAM

CROSS REFERENCE TO RELATED APPLICATION

This application is a U.S. national stage application of PCT/JP2016/082478 filed on Nov. 1, 2016, the contents of which are incorporated herein by reference.

TECHNICAL FIELD

The present disclosure relates to an information processing device, an informing system, an information processing method, and a program.

BACKGROUND ART

Accidents from tumbling over or falling frequently occur in infants and elderly persons due to low cognitive ability. Thus various techniques are proposed in order to prevent such accidents, and products are being marketed for the prevention of accidents.

For example, Patent Literature 1 describes a disadvantaged-person support system that allows a disadvantaged person, such as a child, elderly person, or physically disabled person, to avoid danger by using a portable terminal to warn the disadvantaged person of danger when the disadvantaged person approaches or enters a dangerous location. Moreover, Patent Literature 2 describes a fall-prevention device that, by use of a weight sensor installed on a veranda, detects danger of a person falling from the veranda.

CITATION LIST

Patent Literature

Patent Literature 1: Unexamined Japanese Patent Application Kokai Publication No. 2003-123192

Patent Literature 2: Unexamined Japanese Patent Application Kokai Publication No. 2009-104564

SUMMARY OF INVENTION

Technical Problem

The disadvantaged person support system described in Patent Literature 1 determines whether danger is present on the basis of the present location of a portable terminal retained by the disadvantaged person to be supported, and when the disadvantaged person to be supported is in a dangerous location, the system warns the disadvantaged person of the danger via the portable terminal carried by the disadvantaged person. However, this system suffers from ineffectiveness when the disadvantaged person to be warned does not retain the portable terminal, or when the disadvantaged person, due to low cognitive ability, is unable to recognize the generation of the warning from the portable terminal. Moreover, the fall prevention device described in Patent Literature 2 suffers from an inability to warn of danger unless a dedicated weight sensor is installed on a veranda that is the target of fall prevention.

In consideration of the aforementioned circumstances, an object of the present disclosure is to provide an information processing device, an informing system, an information processing method, and a program that enable detection of danger and informing a user in the vicinity, without the need for the disadvantaged person to be supported to carry the portable terminal, and without the installation of a dedicated sensor.

Solution to Problem

In order to attain the aforementioned objective, an information processing device according to the present disclosure includes:

a recognition information acquirer to acquire, from an electric apparatus that performs operational control using sensor information, recognition information that is information obtained as a result of recognition of the sensor information by an electric apparatus that performs operational control using the sensor information, the sensor information being sensed and output by a sensor;

a danger determiner to determine whether a danger state exists based on the recognition information acquired by the recognition information acquirer.

a signal generator to, upon the danger determiner determining that the danger state exists, generate an informing signal that causes operation of an informing function of an informing apparatus that informs of danger, and a signal transmitter to transmit to the informing apparatus the informing signal generated by the signal generator.

Advantageous Effects of Invention

According to the present disclosure, by the information processing device using information from a previously existing sensor to determine the existence of danger, the user in the vicinity can be informed of danger without requiring the to-be-supported disadvantaged person to carry the portable terminal, and without requiring installation of the dedicated sensor.

BRIEF DESCRIPTION OF DRAWINGS

FIG. 3 illustrates an example of data stored in a sensor apparatus information storage of the information processing device according to Embodiment 1;

FIG. 4 illustrates an example of data stored in an informing apparatus information storage of the information processing device according to Embodiment 1;

FIG. 5 illustrates an example of data stored in an informing event storage of the information processing device according to Embodiment 1:

FIG. 18 illustrates an example of data stored in an informing event storage of an information processing device according to a first modified example of Embodiment 1 of the present disclosure;

FIG. 20 illustrates an example of data stored in an informing event storage of the information processing device according to the second modified example of Embodiment 1;

FIG. 25 illustrates an example of data stored in a sensor apparatus information storage of the information processing device according to Embodiment 2;

FIG. 26 illustrates an example of data stored in the informing event storage of the information processing device according to Embodiment 2;

FIG. 30 illustrates an example of data stored in a sensor apparatus information storage of the information processing device according to Embodiment 3;

DESCRIPTION OF EMBODIMENTS

Figure 1:
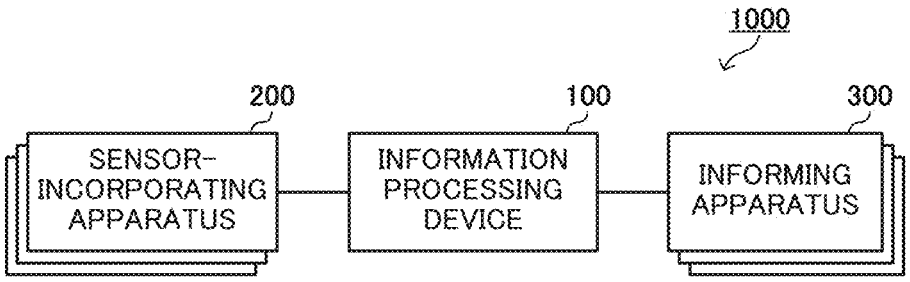
FIG. 1 illustrates an example system configuration of an informing system according to Embodiment 1 of the present disclosure.

An information processing device, an informing system, an information processing method, and a program according to embodiments of the present disclosure are described below in detail with reference to drawings. In the drawings, components that are the same or equivalent are assigned the same reference sign.

Embodiment 1

As illustrated in FIG. 1, an informing system 1000 according to Embodiment 1 of the present disclosure is equipped with an information processing device 100, at least one sensor-incorporating apparatus 200, and at least one informing apparatus 300. Further, part or all of the at least one sensor-incorporating apparatus 200 may be divided into two parts that are (i) sensors and (ii) electric apparatuses equipped with a function for acquiring sensor information output from a sensor. An example of the sensor that can be cited is an image sensor that senses images. Moreover, the "sensor information" is information sensed and output by the sensor. For example, the sensor information detected and output from the image sensor is image information.

The information processing device 100 acquires from the sensor-incorporating apparatus 200 recognition information that is information obtained as a result of recognition of sensor information by the sensor-incorporating apparatus 200. The information processing device 100 determines whether a danger state exists on the basis of such recognition information. Upon determination that the danger state exists, the information processing device 100 generates an informing signal to cause operation of an informing function of the informing apparatus 300, and transmits to the informing apparatus 300 the generated informing signal. Furthermore. "recognition information" is information obtained as a result of recognition of the sensor information. The recognition information, for example, is information concerning presence, absence, or location of an object or person present in a room imaged by the image sensor. Moreover, the "danger state" is a state in which the person included in the recognition information approaches or enters a dangerous location, or alternatively, approaches or touches a dangerous object. Furthermore, the danger state includes a state in which a possibility of danger to a person is determined to exist on the basis of environmental information included in the recognition information, even when the person is not included in the recognition information. Here, examples of environmental information include information about temperature, information about humidity, and information about atmospheric contamination.

The sensor-incorporating apparatus 200 is an electric apparatus that incorporates the sensor and that performs operational control using information detected by the sensor. Examples that can be cited of the sensor-incorporating apparatus 200 include a sensor-equipped air conditioner and a person-detecting sensor-equipped television receiver. As described above, an example that can be cited of the sensor is the image sensor that senses an image. Moreover, the aforementioned sensor-incorporating apparatus 200 may be an electric apparatus equipped with a function for acquiring sensor information detected and output by a sensor that is external rather than incorporated in the sensor-incorporating apparatus 200. In response to a request from the information processing device 100, the sensor-incorporating apparatus 200 transmits to the information processing device 100 the recognition information that is information obtained as a result of recognition of the sensor information.

The informing apparatus 300 is an electric apparatus equipped with the informing function. Here, the term "informing function" means a function for providing to an adjacent user information by at least one of visible information, audio information, or tactile information. Examples that can be cited of the informing apparatus 300 include a smart phone, a mail terminal, a television receiver, and an audio device possessed by the adjacent user. Examples that can be cited of the informing function include a vibration function and a push notification function of the smart phone, a mail display function of the mail terminal, an image display function and an audio output function of the television receiver, and an audio output function of the audio device. The informing apparatus 300 causes operation of the informing function in accordance with the informing signal received from the information processing device 100. Here, the term "adjacent user", for example, means a guardian of a baby, a person in charge of an elderly person, or the like.

The information processing device 100 is connected via a communication interface with the sensor-incorporating apparatus 200 and the informing apparatus 300. The communication interface may be a wired communication interface such as an Ethernet (registered trademark) interface, or alternatively, a wireless communication interface such as a wireless local area network (LAN) interface or a Bluetooth (registered trademark) interface. Moreover, the type of communication interface is not limited to a single type. Separate communication interfaces for each of the sensor-incorporating apparatuses 200, or separate communication interfaces for each of the informing apparatuses 300, may be mixedly used. In the case in which the communication interfaces are mixedly used, the information processing device 100 is required to have functions for using all of such communication interfaces.

As briefly described above, the informing system 1000 is a system that uses the information processing device 100 to determine whether the danger state exists on the basis of the recognition information obtained as a result of recognition of sensor information by the sensor-incorporating apparatus 200, and uses the informing apparatus 300 to inform the adjacent user of danger when the danger state exists. The structure for achieving this system is described by firstly explaining configurations of each device in order.

Figure 2:
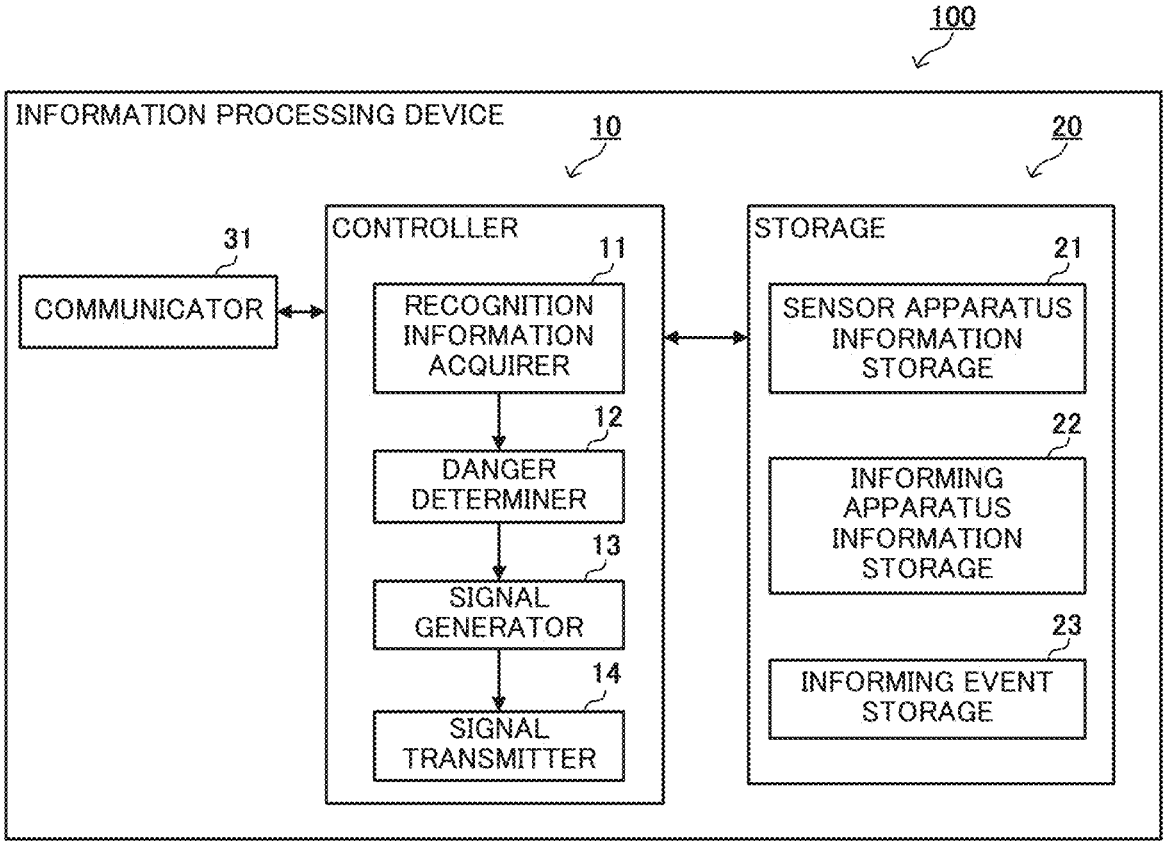
FIG. 2 is a function block diagram of an information processing device according to Embodiment 1.

As illustrated in FIG. 2, the information processing device 100 has a function configuration equipped with a controller 10, a storage 20, and a communicator 31.

The controller 10 is equipped with a central processing unit (CPU), and achieves the functions of various components (a recognition information acquirer 11, a danger determiner 12, a signal generator 13, and a signal transmitter 14) by executing programs stored in the storage 20.

The recognition information acquirer 11 acquires from the sensor-incorporating apparatus 200 via the communicator 31 the recognition information that is information obtained as a result of recognition of the sensor information by the sensor-incorporating apparatus 200. The recognition information differs according to the type of sensor with which the sensor-incorporating apparatus 200 is equipped, and the content of recognition of the sensor-incorporating apparatus 200. For example, in the case in which the sensor is an image sensor and the sensor-incorporating apparatus 200 recognizes location of or existence of an opening, a level difference, or a person, the recognition information is the type of targets of recognition (the opening, the level difference, or the person), and coordinates of each target of recognition. Furthermore, the opening is a portion opened in a wall. Examples that can be cited of the opening include a window, hinged door, and sliding door. Moreover, the level difference is a place where there is a difference in height relative to the floor. Examples that can be cited of the level difference include a stair and a place where an object such as a bed is located that a person can get into or out of.

The danger determiner 12 determines whether the danger state exists on the basis of the recognition information acquired by the recognition information acquirer 11. Specifically, the danger determiner 12 determines whether a determination condition stored in a below-described informing event storage 23 is satisfied by the recognition information. For example, the danger determiner 12 determines whether a positional relationship between a person and an object or location included in the recognition information satisfies the determination condition. Then upon satisfaction of the determination condition, the danger determiner 12 determines that the danger state exists. Furthermore, in the informing event storage 23 is stored the determination condition for determining whether the danger state exists on the basis of the recognition information. The determination condition is a condition such as "the person included in the recognition information is approaching or entering the dangerous location, or is approaching or touching the dangerous object".

Upon determination by the danger determiner 12 that the danger state exists, the signal generator 13 generates the informing signal for causing operation of the informing function of the informing apparatus 300 on the basis of information stored in the below-described informing apparatus information storage 22.

The signal transmitter 14 transmits, via the communicator 31, to the informing apparatus 300 stored in the informing apparatus information storage 22 the informing signal generated by the signal generator 13.

The storage 20 is equipped with a read only memory (ROM) and a random access memory (RAM) as hardware. The ROM stores programs executed by the CPU of the controller 10 and data required beforehand for execution of the programs. The RAM stores data that is created or changed during execution of the programs. The storage 20 is equipped functionally with a sensor apparatus information storage 21, an informing apparatus information storage 22, and an informing event storage 23.

As illustrated in FIG. 3, the sensor apparatus information storage 21 stores information used for communication of the information processing device 100 with the sensor-incorporating apparatus 200. The information stored in the sensor apparatus information storage 21 is a name of the sensor-incorporating apparatus 200, an "effective/ineffective" setting value indicating whether communication with the sensor-incorporating apparatus 200 is presently effective, the type of communication interface used for communication with the sensor-incorporating apparatus 200, identification information of the sensor-incorporating apparatus 200 used during communication, and "transmit recognition information" indicating the type of recognition information transmitted from the sensor-incorporating apparatus 200.

Here, the "identification information" of the sensor-incorporating apparatus 200 is information for uniquely identifying the sensor-incorporating apparatus 200. For example, in the case in which the sensor-incorporating apparatus 200 communicates with the information processing device 100 by Ethernet (registered trademark) or a wireless LAN communication interface, the media access control (MAC) address can be used as such identification information. Moreover, the type of the recognition information transmitted from the sensor-incorporating apparatus 200 refers to the type of information obtained by the sensor-incorporating apparatus 200 recognizing the sensor information, and such recognition information is transmitted to the information processing device 100. For example, if this recognition information is information obtained as a result of recognition of an image, then the type of this recognition information is image recognition information.

The example of storage content of the sensor apparatus information storage 21 illustrated in FIG. 3 indicates that an air conditioner-1 and a television-1 exist as the sensor-incorporating apparatuses 200 capable of communication with the information processing device 100. The air conditioner-1 is indicated to communicate with the information processing device 100 by LAN, to have MAC-2 as the identification information, and to have image recognition information as the recognition information transmitted to the information processing device 100. Moreover, the television-1 is indicated to communicate with the information processing device 100 by LAN, to have MAC-1 as the identification information, and to have image recognition information as the recognition information transmitted to the information processing device 100.

As illustrated in FIG. 4, the informing apparatus information storage 22 stores information used during communication by the information processing device 100 with the informing apparatus 300. The information stored in the informing apparatus information storage 22 is the name of the informing apparatus 300, an "effective/ineffective" setting indicating whether communication with the informing apparatus 300 is presently effective, the type of communication interface used for communication with the informing apparatus 300, identification information of the informing apparatus 300 used during communication, and signal generation information for the informing apparatus 300 as information required for generating the informing signal used by the informing apparatus 300.

Here, the identification information of the informing apparatus 300 is information for uniquely identifying the informing apparatus 300. For example, in the case in which the informing apparatus 300 communicates with the information processing device 100 by Ethernet (registered trademark) or a wireless LAN communication interface, the MAC address can be used as such identification information. Moreover, in the case in which the informing apparatus 300 is the mail terminal, a mail address may be used as the identification information. Moreover, in the case in which the informing apparatus 300, like a portable phone or smart phone, communicates with the information processing device 100 via a wide area network based on the Internet or a phone line network, identification (ID) information of an ID card with which the informing apparatus 300 is equipped or a phone number can be used as the identification information.

Moreover, the signal generation information used by the informing apparatus 300 is information required for generating the informing signal for the informing apparatus 300 as described above. The informing signal for the informing apparatus 300 is a signal for the information processing device 100 to cause the informing apparatus 300 to operate the informing function. In FIG. 4 for simplicity, although informing means only are listed with respect to causing operation of the informing function by the informing apparatuses 300, actually the informing apparatus information storage 22 stores, in addition to the informing means, information as signal generation information required for causing operation of the informing function by the informing means. Thus the informing apparatuses 300 can inform the adjacent user of danger by a method appropriate for the respective apparatus.

For example, in the case in which the informing apparatus 300 is a smart phone carried by the adjacent user, and the smart phone informs the user carrying the smart phone of danger by a message push notification for the smart phone, the informing apparatus information storage 22 stores, as the signal generation information, information for sending the push notification message to the smart phone. Moreover, in the case in which the informing apparatus 300 is a mail terminal carried by the adjacent user, and the mail terminal informs the user retaining the mail terminal of danger by electronic mail, the informing apparatus information storage 22 also stores, as the signal generation information, information of a mail header, such as a character encoding, and transmission source mail address and mail message title. Moreover, in the case in which the informing apparatus 300 is a television receiver and the television receiver informs the adjacent user of danger by screen display or audio output, the informing apparatus information storage 22 stores, as the signal generation information, operating command information of an audio reproduction function unique to the television manufacturer or a character display command using a common protocol such as ECHONET, for example. Moreover, in the case in which the informing apparatus 300 is an audio device and the audio device notifies the adjacent user of danger by an audio output, the informing apparatus information storage 22 stores, as the signal generation information, information of an open protocol or an operating command of an audio reproduction function unique to the audio device manufacturer, for example.

As illustrated in FIG. 5, the informing event storage 23 stores informing events serving as the target for informing the adjacent user of danger. The information of the stored informing event includes: a number of the informing event serving as an informing target, a name of the informing event, an "effective/ineffective" setting indicating whether the informing event is presently effective, and a determination condition for determining whether the informing event is generated. In the example of FIG. 5, "approaching opening" and "approaching level difference" are set as the informing events, and both such informing events are indicated as being presently "effective". Moreover, the "approaching opening" determination condition is indicated to be a condition in which the "'child' is present within 1 m from the 'opening'", and the "approaching level difference" determination condition is indicated to be a condition in which the "'person' is present within 1 m from the 'level difference'". Here, "1 m" is an example of a standard distance threshold for determination of "approaching", and this can be set freely to any value such as "2 m" or "0.5 m" as may be required. Furthermore, the distance between the person and the level difference is a minimum distance between a part capable of determination as the person and a part capable of determination as the level difference. In the same manner, the distance between the person and the opening is the minimum distance between the part capable of determination as the person and a part capable of determination as the opening.

Here, among the determination conditions of"approaching opening", a "child" is listed as a target for sensing. This is an example in which the danger of falling from the opening is considered to be low for a person other than a child even if the person other than a child is an elderly person. For the purpose of ensuring greater safety, the determination condition may be set to a condition that "the 'child' or 'elderly person' is present within 1 m from the 'opening'", or a condition that "the 'person' is present within 1 m from the 'opening'". Moreover, the determination condition is not required to be set using only a distance to the opening, such as "within 1 m", a positional relationship between height of a center of mass of the sensing-target person and height of a lower edge of the opening may be also used as the determination condition. For example, by making the determination conditions that "a 'person' is present within 1 m from the opening and that height of the center of mass of the 'person' is higher than the lower edge of the 'opening'", erroneous determinations can be decreased in comparison to a case of the determination simply based on the distance to the opening.

By setting of the determination condition of the informing event in the above-described manner, the danger determiner 12 can determine whether the danger state exists on the basis of whether the person is in the vicinity of the opening or level difference, and the information processing device 100 can inform the person of the existence of the danger state. Furthermore, the danger determiner 12 is required to be capable of determining whether the aforementioned determination condition is satisfied, on the basis of the recognition information obtained as a result of recognition of the sensor information by the sensor-incorporating apparatus 200 via a below-described recognizer 43. Two examples of determination are described below in which the danger determiner 12 determines whether the determination condition illustrated in FIG. 5 is satisfied. In the first example, a case is described in which the sensor-incorporating apparatus 200 is equipped with a visible light camera as the sensor 62. In this case, the recognizer 43 of the sensor-incorporating apparatus 200, using widely known image recognition technologies including pattern matching technology using image information sensed by the visible light camera, performs estimation of an age of the person, as well as recognition of positions of the opening, the level difference, and the person. Then using as the recognition information the age of the person and the positions of the opening, the level difference, and the person obtained as a result of the recognition, the sensor-incorporating apparatus 200 is required to transmit the recognition information to the information processing device 100.

Figures 6, 7:
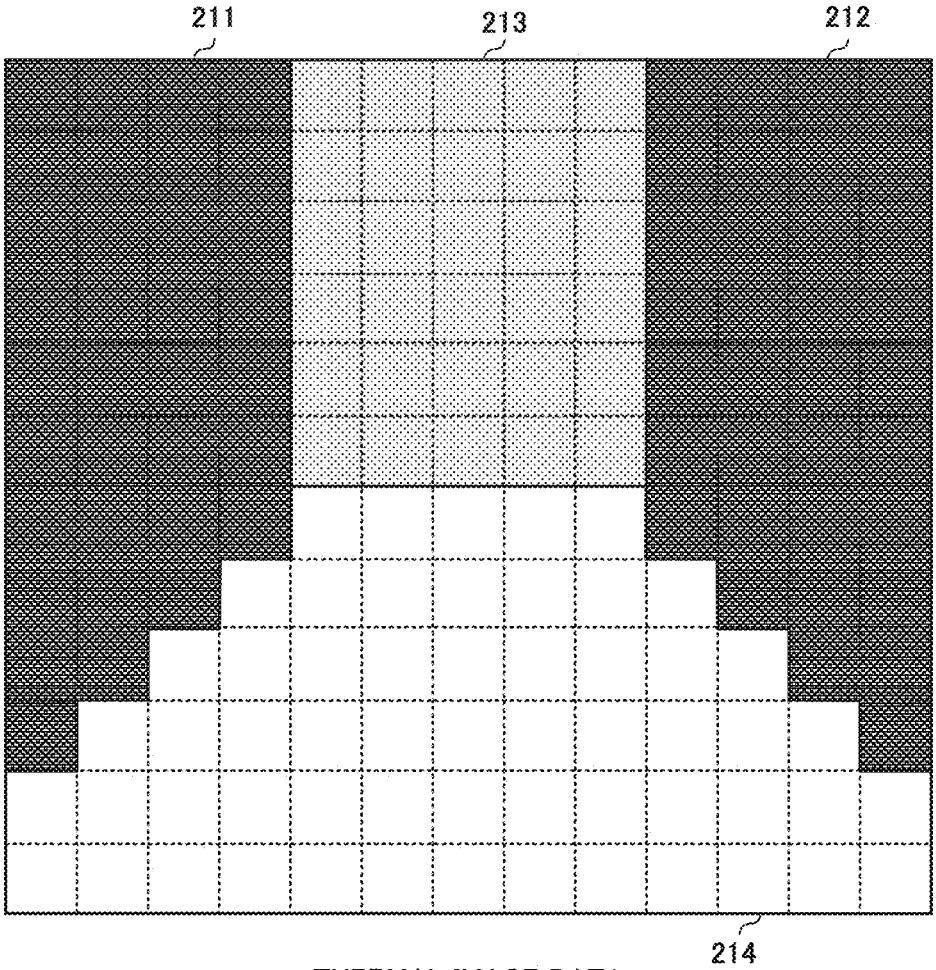
FIG. 6 illustrates an example of thermal imaging data acquired by an infrared camera provided for an air conditioner that is a sensor-incorporating apparatus according to Embodiment 1.
FIG. 7 illustrates a relationship between size of an installation room and capacity of the air conditioner that is the sensor-incorporating apparatus according to Embodiment 1.

A case is described below in which the sensor-incorporating apparatus 200, is equipped with an infrared camera as the sensor 62, as a different example of the danger determiner 12 determining whether the determination condition indicated in FIG. 5 is satisfied. In this case, the sensor-incorporating apparatus 200 can identify a floor region and a wall region of a room on the basis of temperature uniformity of the room imaged by the infrared camera, boundaries between uniform temperatures, and presence-absence of time-wise changes in the temperature uniformity and the boundaries between uniform temperatures. For example, FIG. 6 illustrates an example of thermal imaging data acquired by an infrared camera with which a sensor-equipped air conditioner, as the sensor-incorporating apparatus 200, is equipped. In FIG. 6, increased depth of color indicates increasing temperature. The sensor-equipped air conditioner recognizer 43, on the basis of such thermal imaging data, is capable of recognizing that items 211 and 212 indicated by dark gray coloration are respectively a left wall surface and a right wall surface, that an item 213 indicated by light grey coloration is a front wall, and that the item 214 indicated by white is a floor surface.

Moreover, an air conditioner having a capacity applicable to the size of the room is installed in the room. Such a relationship as illustrated in FIG. 7 exists between the capacity of the air conditioner and a surface area of the installation room to which the air conditioner is applicable. Normally a room is rectangular, and the long side is less than twice the short side. Thus on the basis of such relationships, in FIG. 7, in accordance with each capacity of the air conditioner, a minimum value of the short side of the room, a maximum value of the long side of the room, and a central width value of a depth of the room and a width of the room are each defined. Specifically, the length of the short side of a rectangle having a length-to-side ratio of 1:2 that is a minimum value of the applicable surface area is taken to be a minimum value, the length of the long side of the length-to-side ratio of 1:2 that is a maximum value of the applicable surface area is taken to be a maximum value, and a square root of the central value of the applicable surface area is taken to be the central value. As illustrated in FIG. 7, by the sensor-equipped air conditioner storing beforehand the range of the surface area of the room that can be dealt with by the capacity of the sensor-equipped air conditioner, and the minimum value, maximum value, and central value serving as rough indications of a distance between the air conditioner and each of the walls, the recognizer 43 can surmise, from thermal imaging data such as that illustrated in FIG. 6, the depth of the room and the width and height of the front wall. Furthermore, the size of the room can be set into the air conditioner during installation of the air conditioner.

Figure 8:
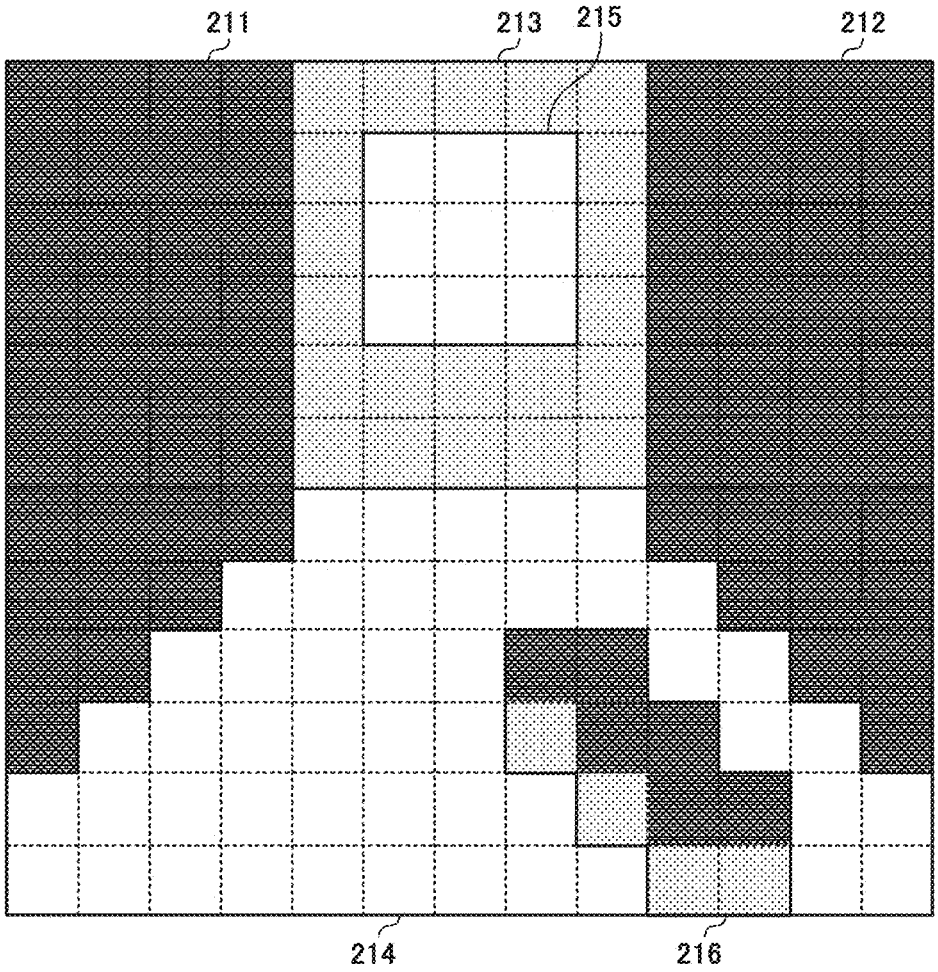
FIG. 8 illustrates a second example of the thermal imaging data acquired by the infrared camera provided for the air conditioner that is the sensor-incorporating apparatus according to Embodiment 1.

FIG. 6 is an example of thermal imaging data of a room that does not have the opening or level difference, and FIG. 8 is an example of thermal imaging of a room that does have the opening and level difference. The recognizer 43 of the sensor-equipped air conditioner, on the basis of the thermal imaging data illustrated in FIG. 8, can recognize that an item 215 indicated by white is an opening that is present in the front wall, and can recognize that an item 216 indicated by light gray coloration and dark gray coloration is a level difference present in the floor. That is to say, if the recognizer 43 discovers that a region that is recognized as the wall has an internal region different, in temperature, from the wall having a size not less than a certain size, the recognizer 43 of the sensor-equipped air conditioner recognizes such an internal region to be an opening. Then if the recognizer 43 of the sensor-equipped air conditioner discovers that a region that is recognized as the floor has an internal region different, in temperature, from the floor having a size not less than a certain size, the recognizer 43 recognizes that this internal region is a level difference. Then, as described above, due to the ability of the sensor-equipped air conditioner to estimate the depth of the room as well as the width and height of the front wall, on the basis of such estimates, the sensor-equipped air conditioner can estimate the distances to the opening and level difference, and the height of the lower edge of the opening.

Figure 9:
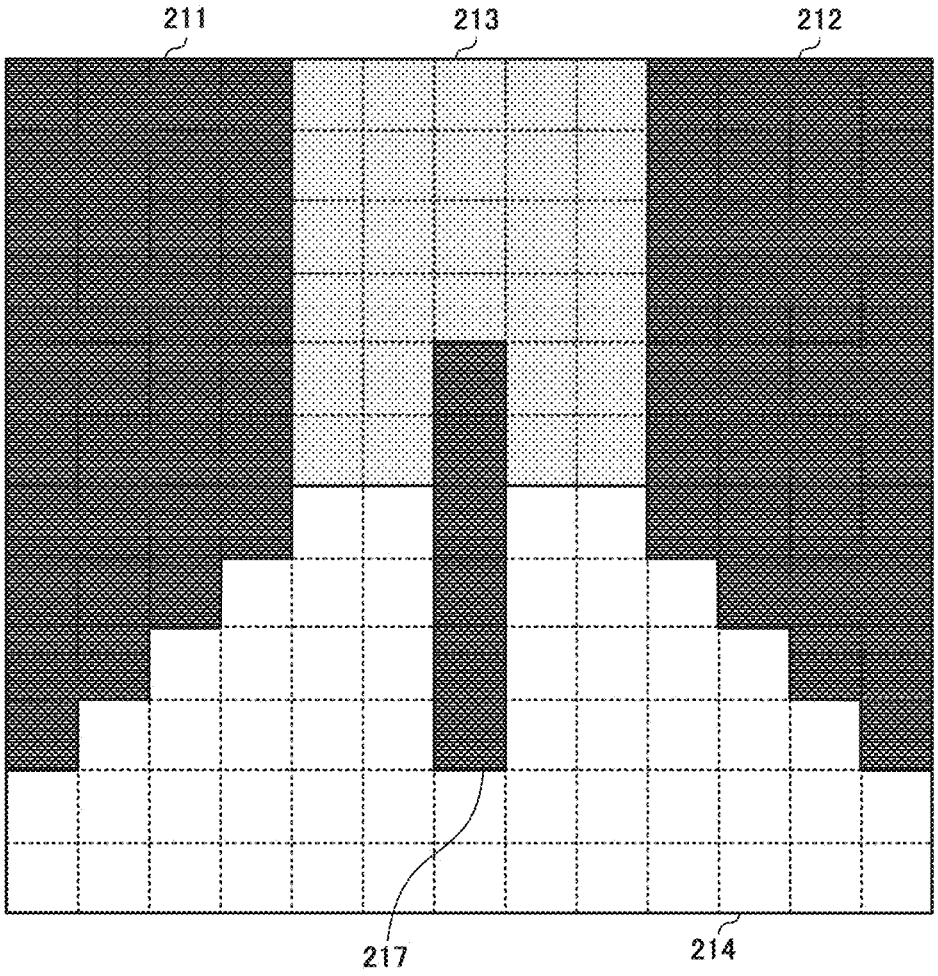
FIG. 9 illustrates a third example of the thermal imaging data acquired by the infrared camera provided for the air conditioner that is the sensor-incorporating apparatus according to Embodiment 1.

When a person is in the room, the resultant thermal imaging data is as show in FIG. 9, for example. The recognizer 43 of the sensor-equipped air conditioner, on the basis of the thermal imaging illustrated in FIG. 9, can recognize that an item 217 indicated by dark gray coloration is a person. That is to say, if a long and thin region of high temperature is present from the floor to the wall, the recognizer 43 of the sensor-equipped air conditioner recognizes that such a region is a person. Then due to the ability of the sensor-equipped air conditioner in the aforementioned manner to estimate the depth of the room and the width and height of the front wall, the recognizer 43 can use such estimated values to estimate a distance to the person and a height of the person. Moreover, in the case in which estimation of the height of the center of mass of the person is required, the recognizer 43 may take the height of the center of mass of the person to be half of the height of the person. However, in the case in which the recognizer 43 has an ability to recognize body shape, the recognizer 43 may estimate the height of the center of mass more accurately on the basis of the body shape. Moreover, in the case in which an ability to estimate age of the person is required, the recognizer 43 can estimate age on the basis on estimated height of the person, for example, by estimating that the person is a child if the estimated height is less than 1.5 in. and that the person is an adult if the estimated height is greater than or equal to 1.5 m. Moreover, in general, body temperature of the child is high, and body temperature of the elderly person is low, and thus the recognizer 43 can estimate age with higher accuracy by using the value of body temperature of the person estimated from the thermal imaging data.

In addition, the recognizer 43 of the sensor-incorporating apparatus 200 may perform recognition processing that combines multiple sensors in accordance with widely known technologies of each of the sensors. Further, if at least one of the sensors is an image sensor using visible or infrared light, the recognizer 43 can recognize shapes included in the images from the image information detected by the sensor, and can perform recognition of objects and persons on the basis of such shapes. Moreover, a microwave Doppler sensor can be cited as an example of a non-imaging type sensor. The microwave Doppler sensor emits microwaves toward the sensing target, and is a sensor that senses shifting of the frequency of the microwaves reflected from the sensing target. Movement of the sensing target is reflected in the shifting of the frequency, and thus the microwave Doppler sensor can use non-contact type sensing of biological information such as breathing and heartbeat of a living body. For example, in the case in which the thermal imaging data of an object heated by the air conditioner is similar to that of a person, by the microwave Doppler sensor sensing vibration of the object and the person, determination is possible that the sensing target is a person if there is vibration, and that the sensing target is an object if there is no vibration. Thus by use of such operation, a living body can be sensed with higher accuracy.

Furthermore, although the information stored in the sensor app sensor apparatus information storage 21, the informing apparatus information storage 22, and the informing event storage 23 may be set at the time of shipment by the manufacturer, such information is preferably variable and freely set by a sales outlet, an installer, or the user of the information processing device 100. In this case, the information processing device 100 may be equipped with a display serving as display means, and a touch panel, keyboard, or mouse serving as input means, and such information can be set and changed using the information processing device 100. Moreover, such information may be settable via a communicator 31 from another information terminal such as a personal computer or smart phone.

The communicator 31 is a communication interface for communication with the sensor-incorporating apparatus 200 and the informing apparatus 300. The communicator 31 may use any communication interface as long as communication is possible with the sensor-incorporating apparatus 200 and the informing apparatus 300. The communicator 31 may be a wired communication interface such as an Ethernet (registered trademark) interface, or alternatively, a wireless communication interface such as a wireless local area network (LAN) interface or a Bluetooth (registered trademark) interface.

Moreover, the communicator 31 is not required to be a communication interface of just one type. For example, the communicator 31 for communication with a first sensor-incorporating apparatus 200 may use Ethernet (registered trademark), the communicator 31 for communication with a second sensor-incorporating apparatus 200 may use universal serial bus (USB), the communicator 31 for communication with a first informing apparatus 300 may use a wireless LAN, and the communicator 31 for communication with a second informing apparatus 300 may use Bluetooth (registered trademark).

Figure 10:
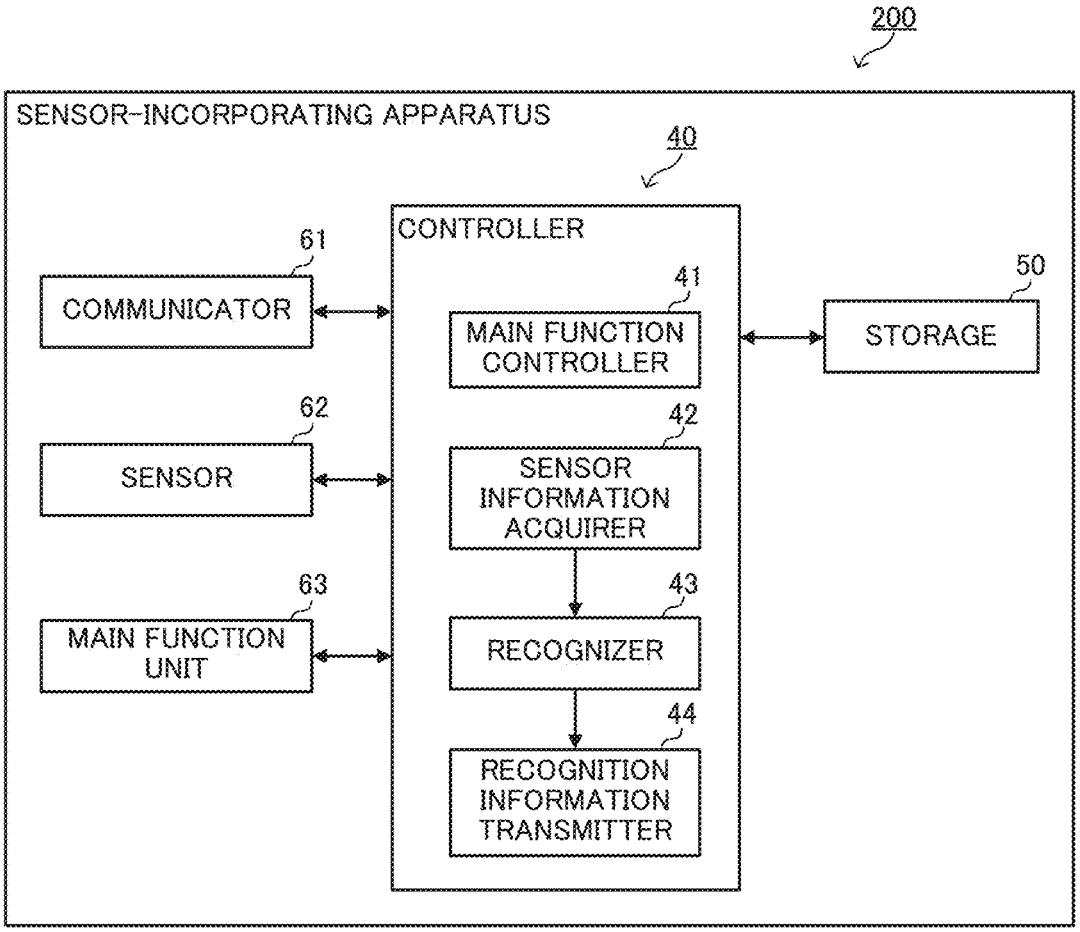
FIG. 10 is a function block diagram of the sensor-incorporating apparatus according to Embodiment 1.

Configuration of the sensor-incorporating apparatus 200 is described next. As illustrated in FIG. 10, the sensor-incorporating apparatus 200 is equipped, as the functional configuration, with a controller 40, a storage 50, a communicator 61, a sensor 62, and a main function unit 63.

The controller 40 is equipped with a CPU, and by executing programs stored in the storage 50, achieves the function of each of the components of the sensor-incorporating apparatus 200, that is, a main function controller 41, a sensor information acquirer 42, a recognizer 43, and a recognition information transmitter 44. Moreover, the controller 40 is equipped with a multi-thread function, and is capable of executing multiple types of processing in parallel. The storage 50 is equipped with a RAM and a ROM, and stores basic software of the sensor-incorporating apparatus 200 and programs and required data of software for achieving each of the functions. The communicator 61 is equipped with a communication device and is a communication interface for communication with the information processing device 100. This communication interface can be any type of communication interface as long as the communication interface can communicate with the information processing device 100. The sensor 62 is equipped with a sensor device and outputs to the sensor information acquirer 42 the sensor information sensed in accordance with the type of the sensor device.

The main function unit 63 achieves the main functions of the sensor-incorporating apparatus 200. For example, if the sensor-incorporating apparatus 200 is an air conditioner, the main function unit 63 includes a refrigeration cycle that is a compressor and a heat exchanger, and a blower mechanism. Moreover, in the case in which the sensor-incorporating apparatus 200 is the television receiver, the main function unit 63 includes a tuner, and image display, and a speaker.

The various components of the controller 40 are described next. The main function controller 41 controls the main function unit 63. The sensor information acquirer 42 acquires the sensor information sensed and output by the sensor 62. The recognizer 43 recognizes the sensor information acquired by the sensor information acquirer 42, obtains the recognition information, and stores the recognition information in the storage 50. For example, in the case in which the sensor 62 is an image sensor such as the visible light camera or the infrared camera, and the sensor-incorporating apparatus 200 performs the image recognition, the recognizer 43 recognizes the shape and position of the object and the living body, and stores, in the storage 50 as the recognition information, information on the shape and position of the object and the living body obtained as a result of recognition. The recognition of the shape and position of the object and living body can be performed using widely known technologies including pattern matching technology, as described above in the example of determination of using the determination condition stored in the informing event storage 23.

The recognition information transmitter 44 transmits, to the information processing device 100 via the communicator 61, the recognition information stored in the storage 50 on the basis of a request from the information processing device 100.

Figure 11:
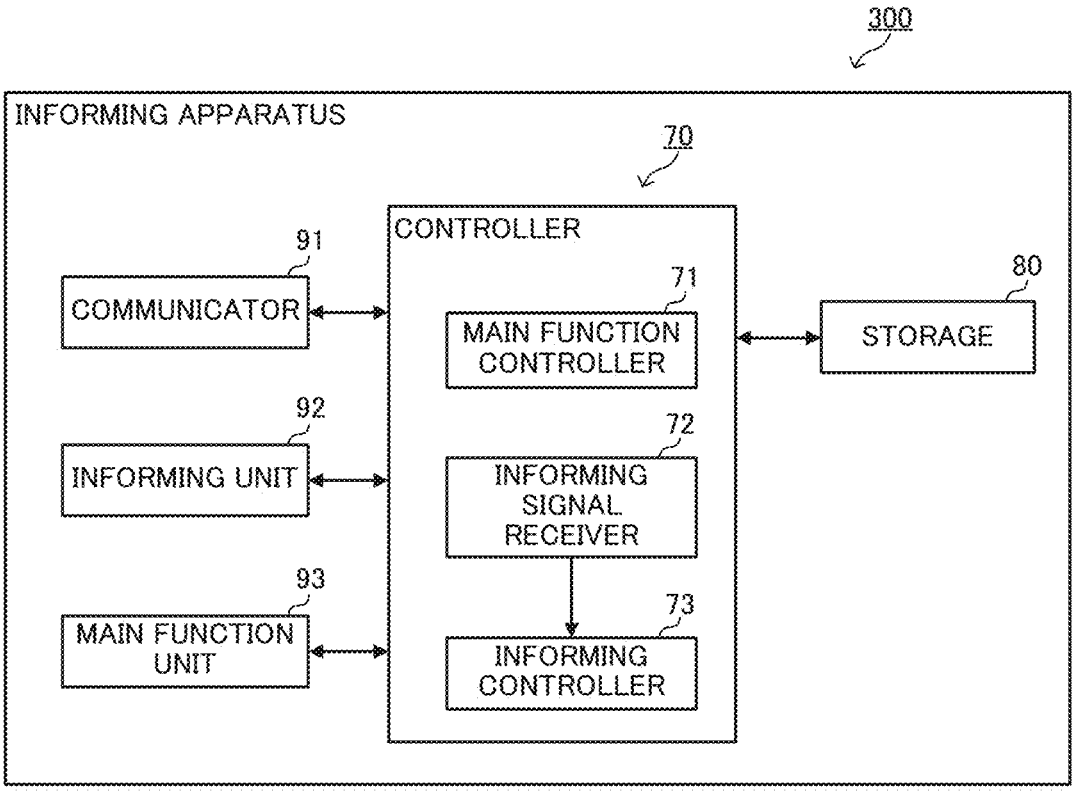
FIG. 11 is a function block diagram of an informing apparatus according to Embodiment 1.

Next, configuration of the informing apparatus 300 is described. As illustrated in FIG. 11, the informing apparatus 300 is equipped, as the functional configuration, with a controller 70, a storage 80, a communicator 91, an informing unit 92, and a main function unit 93.

Due to execution of the program stored in the storage 80, the controller 70 achieves each of the functions of the components of the informing apparatus 300, that is, a main function controller 71, an informing signal receiver 72, and an informing controller 73. Moreover, the controller 70 has an a multithreading ability to execute multiple processes (threads) concurrently. The storage 80 is equipped with a RAM and a ROM, and stores basic software of the informing apparatus 300 and software of programs and required data for achieving each of the functions. The communicator 91 is equipped with a communication device, and is a communication interface that communicates with the information processing device 100. This communication interface can be any type as long as the communication interface can communicate with the information processing device 100. The informing unit 92 is equipped with a device that transmits information to at least one type among a human visual sense, human auditory sense, and human tactile sense and transmits the information to a person. Examples of this device that can be cited include a display device that displays character information, a speaker that outputs sound, and a motor that generates vibrations.

The main function unit 93 achieves the main functions of the informing apparatus 300. For example, if the informing apparatus 300 is the television receiver, the main function unit 93 includes the tuner, the image display, and the speaker.

Various components of the controller 70 are described next. The main function controller 71 controls the main function unit 93. The informing signal receiver 72 receives, via the communicator 91, the informing signal from the information processing device 100. The informing controller 73 controls the informing unit 92 in accordance with the informing signal received by the informing signal receiver 72. Thus the information from the informing unit 92 is provided, and the informing function of the informing apparatus 300 operates. Furthermore, cases also occur in which the informing unit 92 is included in the main function unit 93, such as in the speaker and the image display of the television receiver, for example.

Processing performed by the various devices is described next. Firstly, the recognition information save processing in which the sensor-incorporating apparatus 200 recognizes the sensor information detected by the sensor 62, and the recognition information transmission processing in which the sensor-incorporating apparatus 200 transmits to the information processing device 100 the recognized recognition information, are described in order. Initially the recognition information save processing performed by the sensor-incorporating apparatus 200 is described with reference to FIG. 12. The start of this processing is triggered by reading of the sensor information by the main function unit 63 of the sensor-incorporating apparatus 200. Here, the sensor 62 is equipped with an image sensor, and the information sensed and output by the sensor 62 is described as image data.

Firstly, the sensor information acquirer 42 acquires from the sensor 62 information detected by the sensor (step S101). Then the recognizer 43 recognizes the shape and position of the object and living body on the basis of the information acquired by the sensor information acquirer 42 (step S102).

Then the recognizer 43 saves in the storage 50 the recognition information that is information obtained as a result of recognition (step S103), and ends the recognition information save processing.

In the aforementioned manner, such processing is an example in which the sensor 62 is equipped with an image sensor and the recognizer 43 performs image recognition on the image data sensed and output by the sensor 62, and the recognition information is information on the shape and position of the object and the living body. The recognition information saved in the storage 50 varies according to the type of the recognition information required by the main function unit 63 and the type of the sensor with which the sensor 62 of the sensor-incorporating apparatus 200 is equipped, and thus the recognition information save processing may partially differ from the above-described processing. For example, in the case in which audio information is required by the main function unit 63, the sensor 62 is equipped with a sound sensor, the recognizer 43 performs voice recognition on the sound sensed by the sound sensor, and information obtained as a result of the voice recognition is stored in the storage 50 as the recognition information. In this case, the recognition information, for example, is text data obtained by conversion of voice into text.

Next, the recognition information transmission processing performed by the sensor-incorporating apparatus 200 is described with reference to FIG. 13. Upon startup of the sensor-incorporating apparatus 200 this recognition information transmission processing is started in parallel as a thread separate from the processing of the main function of the sensor-incorporating apparatus 200.

Firstly, the controller 40 of the sensor-incorporating apparatus 200 determines whether there is a request from the information processing device 100 for transmission of the recognition information (step S11). If there is no transmission request for the recognition information (NO in step S111), processing returns to step S111. If there is a transmission request for the recognition information (YES in step S11), then the recognition information transmitter 44 reads the recognition information saved in the storage 50, and transmits the read recognition information to the information processing device 100 via the communicator 61 (step S112). Then processing returns to step S111.

Determination transmission processing performed by the information processing device 100 is described next with reference to FIG. 14. Upon startup of the information processing device 100, this determination transmission processing starts. When determination is made by such processing that the danger state exists, the information processing device 100 transmits to the informing apparatus 300 the informing signal for causing operation of the informing function of the informing apparatus 300).

Firstly, the recognition information acquirer 11 acquires the recognition information from the sensor-incorporating apparatus 200 via the communicator 31 (step S201). Then the danger determiner 12 executes the danger determination processing (step S202). Details of the danger determination processing are described below. Then the danger determiner 12 determines, as a result of the danger determination processing, whether the danger state exists (step S203). Upon determination that the danger state does not exist (NO in step S203), the processing proceeds to step S208.

Upon determination by the danger determiner 12 that the danger state exists (YES in step S203), the controller 10 reads the informing apparatus information storage 22 (step S204). The controller 10, on the basis of the content of the read informing apparatus information storage 22, determines whether there is an effective informing apparatus 300 (step S205). This determination can be made by whether the "effective/ineffective" column of the informing apparatus information storage 22 illustrated in FIG. 4 is "effective". If no effective informing apparatus 300 exists (NO in step S205), the processing proceeds to step S208.

If an effective informing apparatus exists (YES in step S205), the signal generator 13 generates for all of the effective informing apparatuses 300 the informing signals corresponding to the effective informing apparatus 300, on the basis of the "communication interface", the "identification information", and the "signal generation information" of the informing apparatus information storage 22 illustrated in FIG. 4 (step 206). Then the signal transmitter 14 transmits, to all of the effective informing apparatuses 300 via the communicator 31, the informing signal generated by the signal generator 13 (step S207), and the processing proceeds to step 208.

In step S208, the controller 10 determines whether the processing program of the information processing device 100 is presently operating. If the processing program is presently operating (YES in step S208), processing returns to step S201. If the processing programs is presently not operating (NO in step S208), the processing ends.

Figure 15:
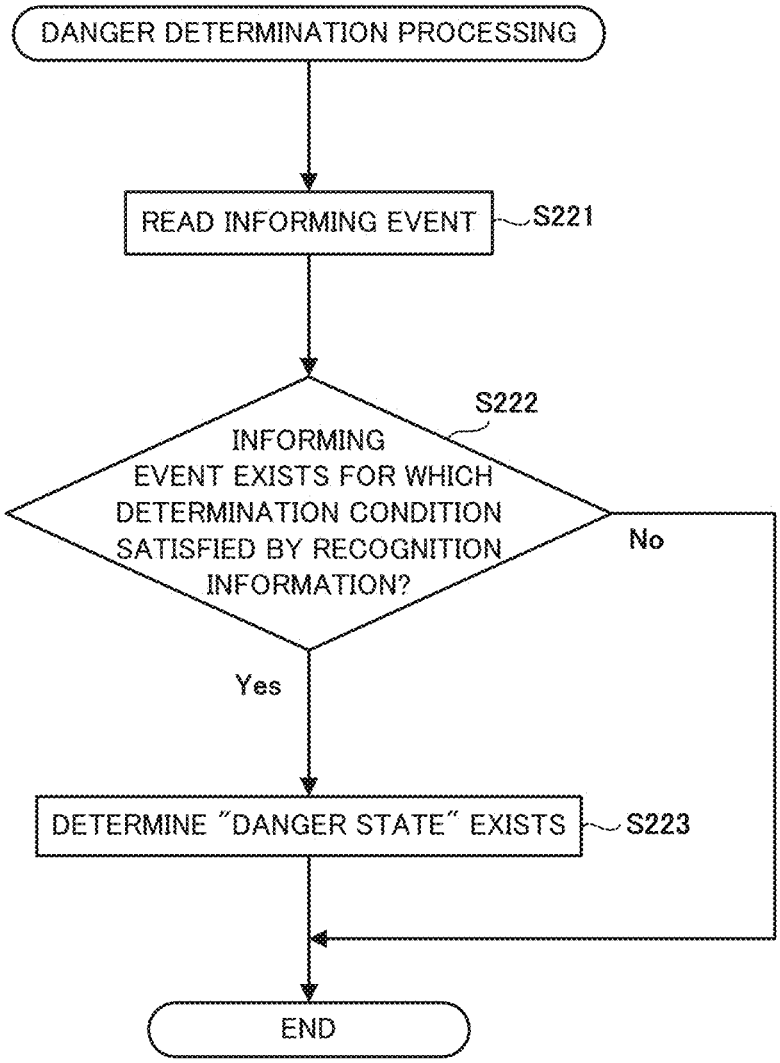
FIG. 15 is a flowchart of danger determination processing of the information processing device according to Embodiment 1.

Next, the danger determination processing executed in step S202 is described with reference to FIG. 15. This processing is processing by which the danger determiner 12 determines whether the danger state exists, on the basis of determination of whether the recognition information acquired from the sensor-incorporating apparatus 200 satisfies the "determination condition" stored in the informing event storage 23.

Firstly, the danger determiner 12 reads the informing event stored in the informing event storage 23 (step S221). Then the danger determiner 12 compares the recognition information acquired by the recognition information acquirer 1 in step S201 of FIG. 14 with the "determination condition" of the informing event read in step S221, and determines whether, according to the recognition information, an informing event for which the determination condition is satisfied exists (step S222). If no informing event exists for which the determination condition is satisfied (NO in step S222), the processing ends. If an informing event exists for which the determination condition is satisfied (YES in step S222), the danger determiner 12 determines that the danger state exists (step S223), and the processing ends.

In the case in which the recognition information acquired by the recognition information acquirer 11 satisfies the determination condition stored in the informing event storage 23 by the above-described determination transmission processing and the above-described danger determination processing of the information device 100, the danger determiner 12 determines that the danger state exists, and the information processing device 100 transmits the informing signal to the informing apparatus 300.

Next, the informing processing to cause the informing apparatus 300 having received the informing signal to operate the informing function is described with reference to FIG. 16. Upon startup of the informing apparatus 300, this informing processing starts in parallel as a thread separate from the main function of the informing apparatus 300).

Firstly, the informing signal receiver 72 of the informing apparatus 300 determines whether a transmission exists of the informing signal from the information processing device 100 via the communicator 91 (step S301). If no transmission of the informing signal exists (NO in step S301), the processing returns to step S301. If the transmission of the informing signal exists (YES in step S301), the informing signal receiver 72 receives the informing signal via the communicator 91 (step S302).

Then in accordance with the informing signal received by the informing signal receiver 72, the informing controller 73 controls the informing unit 92, and causing operation of the informing function of the informing apparatus 300 (step S303), and the processing returns to step S301.

Due to such informing processing, the informing apparatus 300 can cause operation of the informing function in response to the each informing unit 92, and can cause notification of danger to be provided to the adjacent user.

Figure 17:
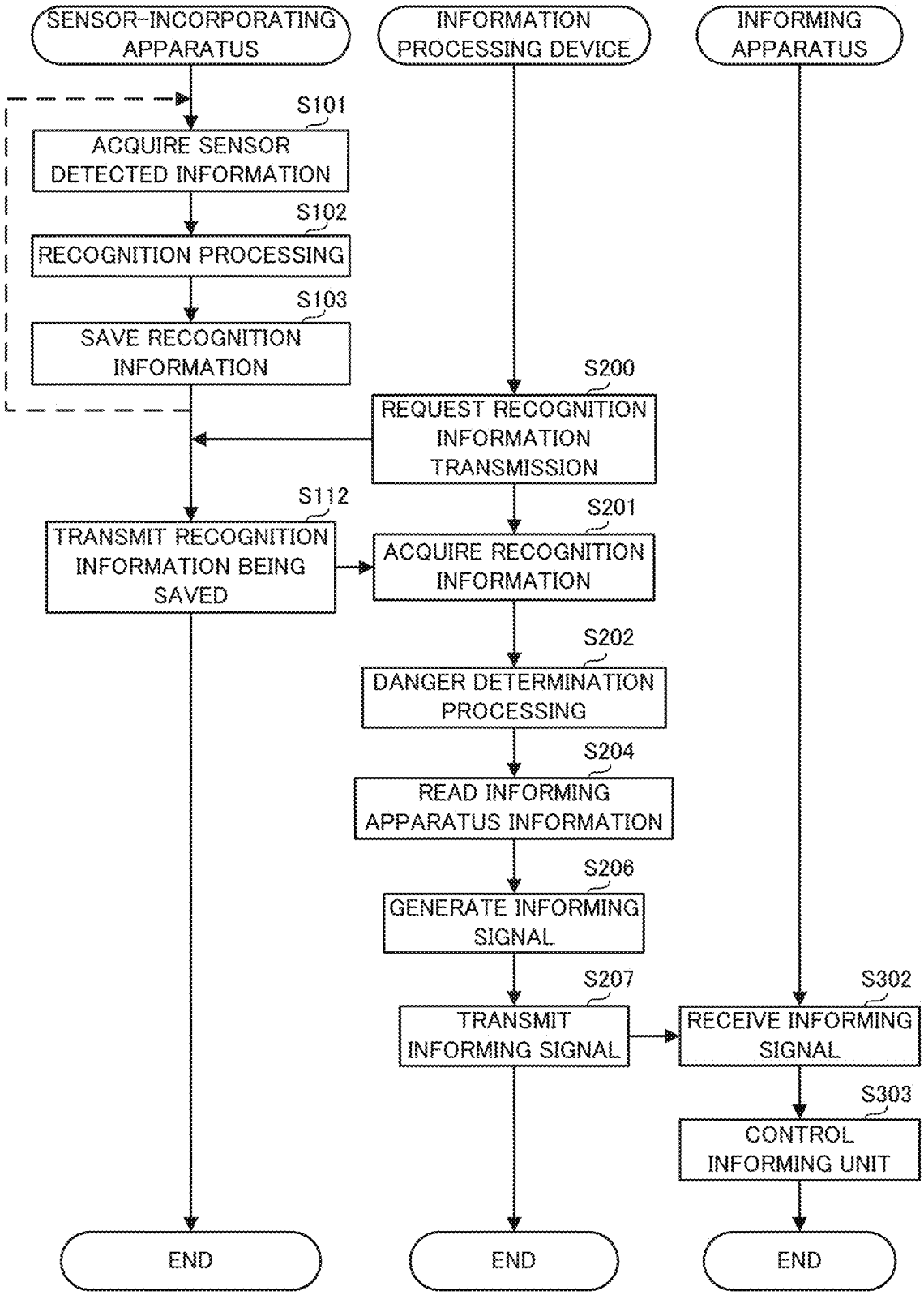
FIG. 17 is an operating sequence chart of the informing system according to Embodiment 1.

Although the above descriptions concerning the processing of each of the devices are completed, the operating sequence of the overall informing system 1000 is described with reference to FIG. 17 in the case of occurrence of the danger state. In the operating sequence chart illustrated in FIG. 17, the same reference sign is assigned for processing that is the same as the processing occurring in the aforementioned flowcharts and steps.

Upon performance of reading of the sensor information by the main function unit 63 of the sensor-incorporating apparatus 200, the sensor information acquirer 42 acquires, from the sensor 62, the sensor information sensed and output by the sensor (step S101). Then the recognizer 43 recognizes the sensor information (step S102), and saves in the storage 50 the recognition information obtained as a result of recognition (step S103). This processing is executed each time the reading of the sensor information is performed by the main function unit 63, and the recognition information saved in the storage 50 is updated each time.

Upon acquisition of the recognition information, the information processing device 100 requests the sensor-incorporating apparatus 200 to transmit the recognition information (step S200). The sensor-incorporating apparatus 200, in reply to the transmission request, transmits to the information processing device 100 the recognition information saved in the storage 50 (step S112). Thereafter, the information processing device 100 acquires the recognition information transmitted from the sensor-incorporating apparatus 200 (step S201), and performs the danger determination processing (step S202) on the basis the acquired recognition information.

In the case of determination by the danger determiner 12 of the information processing device 100 that the danger state exists, the controller 10 reads information of the informing apparatus 300 from the informing apparatus information storage 22 (step S204). Then the signal generator 13 generates the informing signals on the basis of such information (step S206), and the signal transmitter 14 transmits the informing signals to the informing apparatuses 300 (step S207).

The informing apparatus 300 receives the informing signal transmitted by the information processing device 100 (step S302), and by the informing controller 73 controlling the informing unit 92 in accordance with the received informing signal, the informing function is performed (step S303).

Due to the aforementioned processing, even without installation of a dedicated sensor, the informing system 1000 can determine whether the danger state exists, and when the danger state exists, can inform the adjacent user of the existence of the danger state. Moreover, by setting the determination condition of the informing event to "approach of the person to the opening or the level difference", a person, particularly, a baby and an elderly person having low cognitive capacity can be prevented from falling from the opening or the level difference.

First Modified Example of Embodiment 1

In the aforementioned Embodiment 1, in the case of determination that the danger state exits, the information processing device 100 transmits the informing signal to the informing apparatus 300. However, such processing of the aforementioned embodiment is not limiting. For example, in a first modified example of Embodiment 1, with respect to the danger state in the case of a person approaching the opening, the information processing device 100 may transmit, to an electrically-driven shutter arranged at the opening, a signal to cause the electrically-driven shutter to close. In order to achieve such a system, the storage 20 may be equipped with a non-illustrated control apparatus information storage that stores a correspondence relationship between the opening and information similar to that of the informing apparatus information storage 22, and the informing event storage 23 may also store "control content" as illustrated in FIG. 18. This first modified example can perform danger avoidance more reliably by performing apparatus control rather than just informing.

Second Modified Example of Embodiment 1

In the aforementioned Embodiment 1, the existence of the danger state is determined on the basis of determination of whether a positional relationship between a person and the object or location included in the newest recognition information satisfies the determination condition stored in the informing event storage 23. However, a past record of the recognition information may be recorded beforehand, and by using both the past recognition information and the present recognition information, movement of an object used for determination of danger may be detected, and processing may be performed in reaction to the movement of the object used for determination of danger. A second modified example of Embodiment 1 to enable such processing is described below.

Figure 19:
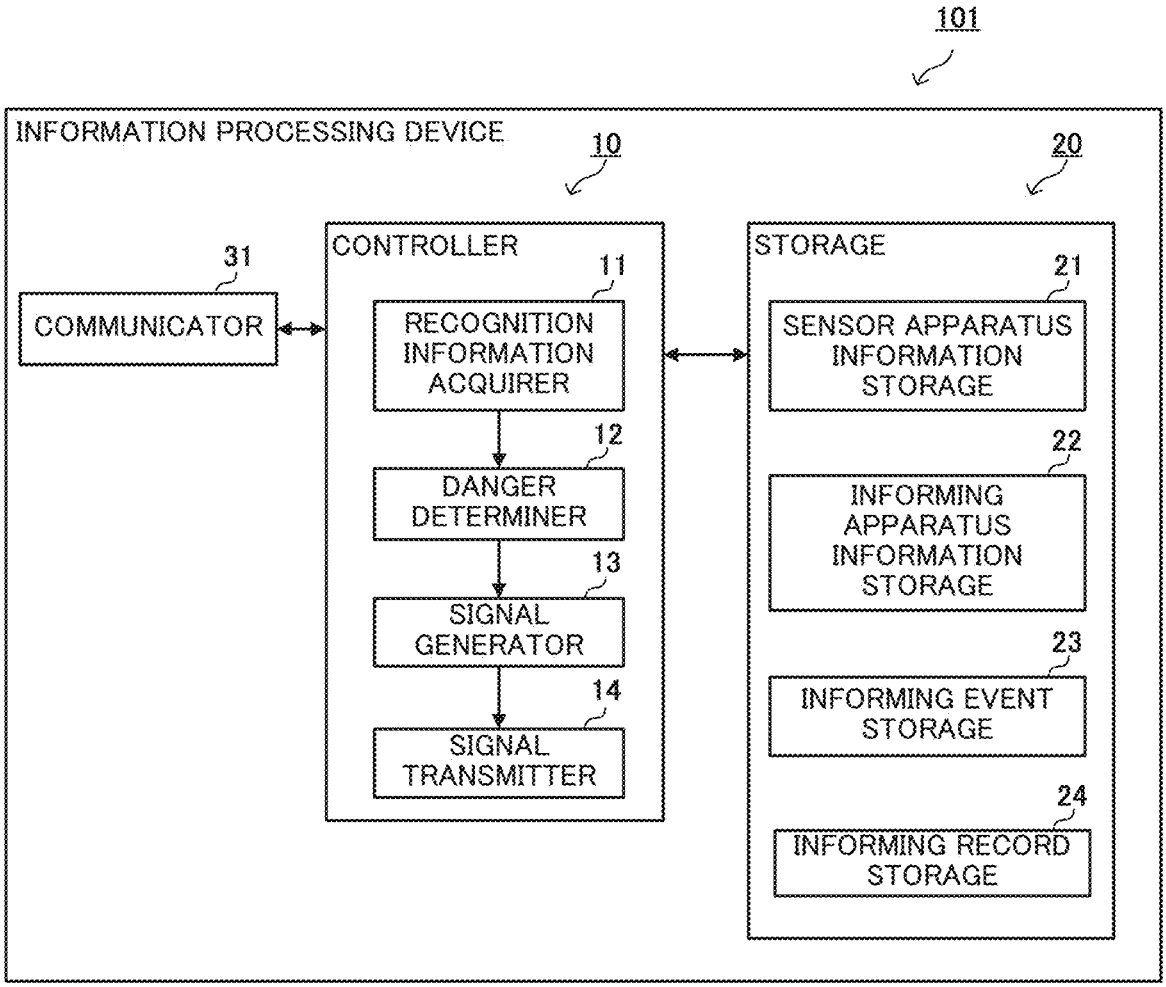
FIG. 19 is a function block diagram of an information processing device of a second modified example of Embodiment 1 of the present disclosure.

An information processing device 101 according to the second modified example of Embodiment 1, as illustrated in FIG. 19, is equipped with the controller 10, the storage 20, and the communicator 31. Since many of these components are the same as the components of the information processing device 100 according to Embodiment 1, only the components that differ from those of Embodiment 1 are described. The information processing device 101 differs from the information processing device 100 with respect to three points: the information storage 20 is equipped with a recognition record storage 24, a "record determination" column is present in the information stored in the informing event storage 23, and state change determination processing is added into the danger determination processing.

The recognition record storage 24 stores the record of the recognition information acquired by the recognition information acquirer 11. Although the count of saved records can be set to a freely selected value, here an example is described of a case in which the count of saved records is one immediately recent record.

As illustrated in FIG. 20, a "record determination" column is added to the informing event storage 23 of the information processing device 101. Determination processing using the past recognition information and present recognition information can be performed by determining whether the present recognition information satisfies the "determination condition" in the case in which past recognition information stored in the recognition record storage 24 satisfies the "determination condition" of the row corresponding to a number written in a "record determination" column. An example is described here in which the informing event is taken to be the third informing event listed in FIG. 20, the previous recognition information satisfies the determination condition that is the "'child' is present within 1 m from 'opening'", and the present recognition information satisfies the determination condition that is the "'child' is presently beyond 'opening'". In this case, the previous recognition information satisfies the "determination condition" of row 001 in the "record determination", and the present recognition information satisfies the third row "determination condition", and thus the danger determiner 12 determines that the danger state exists that has the third row "informing event name" that is "falling from opening". Moreover, the determination condition that is the "'child' is beyond 'opening'" is satisfied when an angular difference between the direction of the "child" relative to the center of the room and the direction of the opening is less than a standard directional threshold, and further when a distance of the "child" from the center of the room is larger than the distance of the "opening" from the center of the room. The standard directional threshold is set here to 30 degrees, for example.

A different example is also described in which the informing event is taken to be the fourth row informing event listed in FIG. 20, the previous recognition information satisfies the determination condition that is the "'person' is present within 1 m from 'level difference'", and the present recognition information satisfies the determination condition that is the "'person' is presently below 'level difference'". In this case, the previous recognition information satisfies the "determination condition" of the 002 row in the "record determination", the present recognition information satisfies the "determination condition" of the fourth row, and thus the danger determiner 12 determines that the danger state exists that has the fourth row "informing event name" that is "falling down level difference". By using the record of the recognition information in this manner, the danger determiner 12 can determine that, although previously the danger state existed that is "approaching opening" or "approaching level difference", now the danger state has changed to "falling from opening" or "falling down level difference". Furthermore, the determination condition that the "'person' is below 'level difference'" is satisfied in the case in which the distance between the "level difference" and the "person" is less than or equal to the standard distance threshold and the center of mass of the "person" is lower that height of the highest part of the "level difference". Here, the standard distance threshold is set to 1 m, for example.

The danger determination processing of the information processing device 101 for performing such determination is described with reference to FIG. 21. However, steps S221 to S223 during such processing are identical to such steps of the danger determination processing of the information processing device 100, and thus only step S224 and beyond are described.

When, in step S222, there is no informing event that satisfies the determination condition (NO in step S222), the danger determiner 12 performs state change determination processing (step S224). Details of this state change determination processing are described below. Then the danger determiner 12 determines whether, as a result of the determination during the state change determination processing, the "informing event" is being generated (step S225). If the "informing event" is determined to be occurring (YES in step S225), the danger determiner 12 determines that the danger state exists (step S223). If the "informing event" is determined not to be occurring (NO in step S225), the processing proceeds to step S226.

Figure 14:
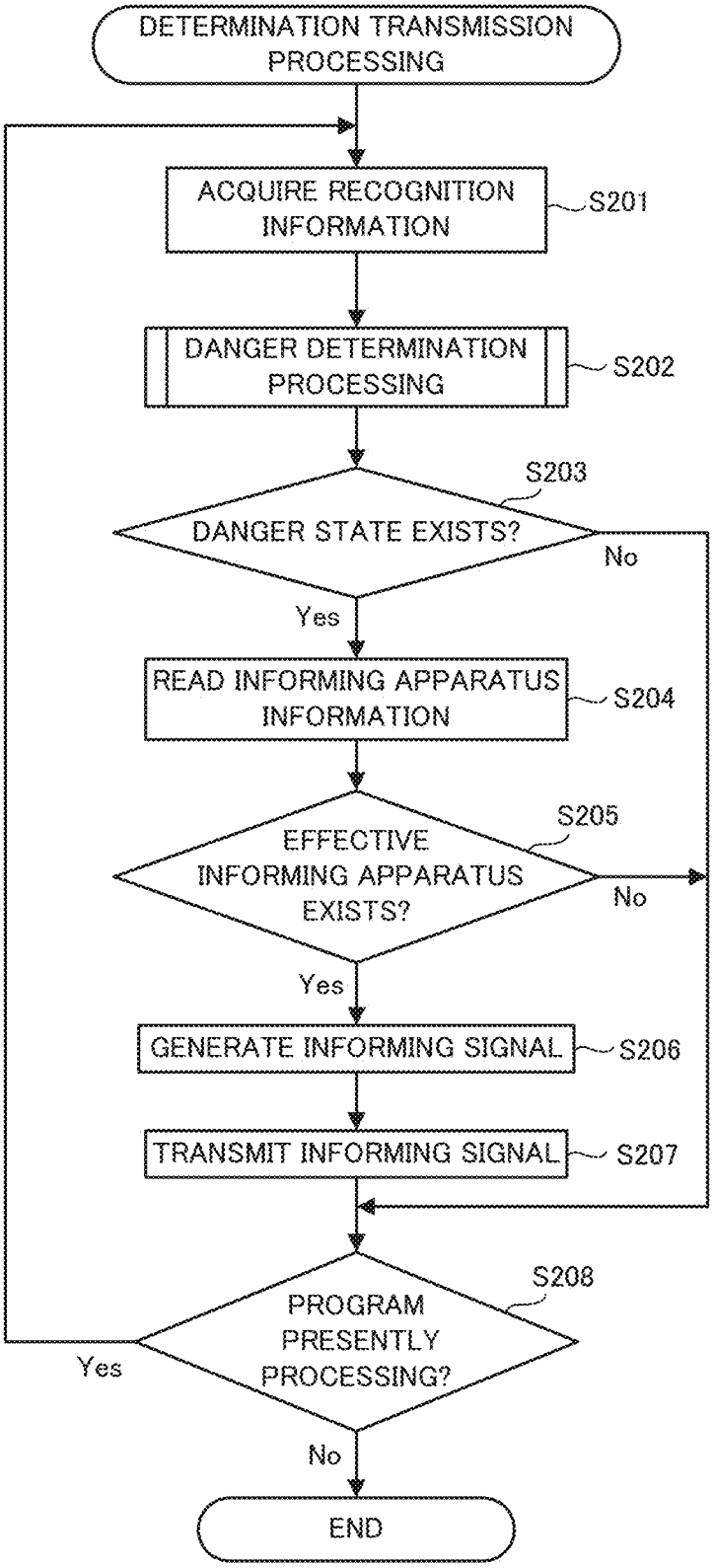
FIG. 14 is a flowchart of determination transmission processing of the information processing device according to Embodiment 1.

After step S223, the processing proceeds to step S226, and in step S226, the controller 10 stores in the recognition record storage 24 the recognition information acquired by the recognition information acquirer 11 in step S201 illustrated in FIG. 14. Then the processing ends. Furthermore, although not illustrated in FIG. 21, when the determination in step S222 is NO in a state in which the previous recognition information is not stored in the recognition record storage 24, the processing of step S224 and beyond is preferably omitted, and the processing preferably transitions to step S226.

Figure 22:
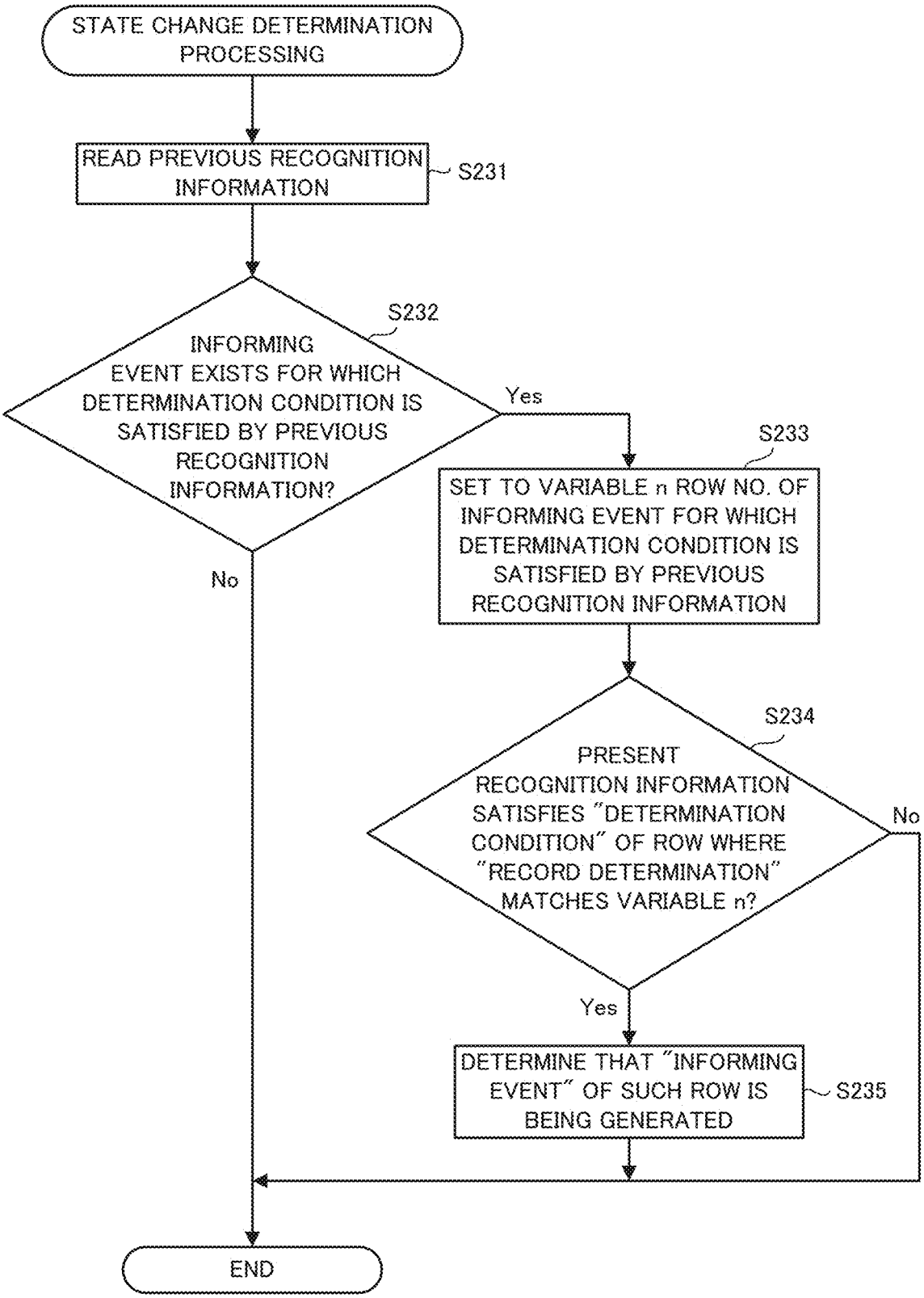
FIG. 22 is a flowchart of state change determination processing of the information processing device according to the second modified example of Embodiment 1.

Next, the state change determination processing performed in step S224 is described with reference to FIG. 22. Firstly, the controller 10 reads the previous recognition information from the recognition record storage 24 (step S231). Then the danger determiner 12 determines whether an informing event exists for which the determination condition is satisfied by the previous recognition information (step S232). If there is no informing event for which the determination condition is satisfied by the previous recognition information (NO in step S232), the processing ends.

If there exists an informing event for which the determination condition is satisfied by the previous recognition information (YES in step S232), the controller 10 sets to a variable n the row number of the informing event for which the determination condition is satisfied by the previous recognition information (step S233). Then the danger determiner 12 determines whether the present recognition information satisfies the "determination condition" of the row at which the "record determination" column of the informing event storage 23 is the variable n (step S234). If the determination is that the present recognition information does not satisfy such a "determination condition" (NO in step S234), the processing ends.

If the present recognition information satisfies the "determination condition" of the row where the "record determination" column of the informing event storage 23 is the variable n (YES in step S234), the danger determiner 12 determines that an informing event is being generated that corresponds to the "informing event name" of the row where the "record determination" column is the variable n (step S235). Then the processing ends.

Figure 21:
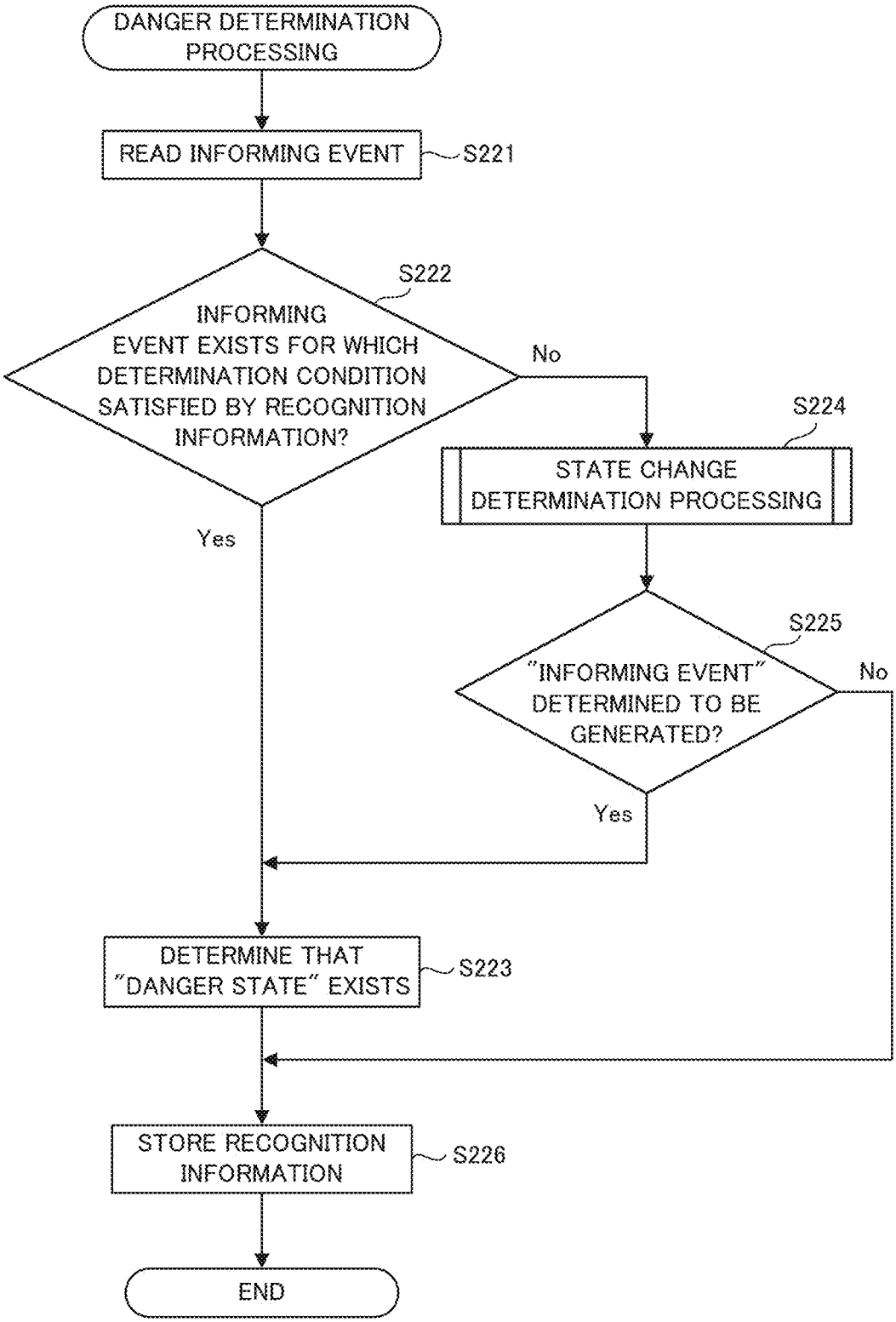
FIG. 21 is a flowchart of danger determination processing of the information processing device according to the second modified example of Embodiment 1.

Further, although in FIG. 21 determination is firstly made as to whether there is an informing event for which the determination condition is satisfied by the present recognition information, and the state change determination processing is performed if there is no informing event for which the determination condition is satisfied, the order of processing is not limited to that of this processing. After the performance of the state change determination processing, determination may be made as to whether an informing event exists for which the determination condition is satisfied by the present recognition state.

Furthermore, in the case in which multiple informing events are determined to be generated, informing may be performed for all such informing events. However, cases may occur in which excessive time may be required for performing informing of all such informing events. Moreover, the adjacent user may become distracted when informing of all such informing events is performed. In such a case, for example, an order of priority may be assigned to the informing event, and confirmation as to whether the determination condition is satisfied may be performed in descending order from the informing event having the higher order of priority. Further, the count of the informing events for which informing is simultaneously performed, for example, may be limited to a predetermined count of the informing events for which informing is performed, with the priorities of the informing events previously set in descending order from the informing events having higher order of priority.

According to the second modified example of Embodiment 1 as described above, time-wise change of the recognition information can be understood by using the record of the recognition information, and thus response to various kinds of danger states is possible. Moreover, informing of occurrence of a fall can be performed promptly, and thus for example, the fact that an elderly person or a baby has fallen from a bed or level difference can be discovered promptly, thereby avoiding increased severity of the injury.

Embodiment 2

In Embodiment 1, the sensor-incorporating apparatus 200 performs recognition processing on the basis of the sensor information, and the information processing device 100 acquires the recognition information, that is the result obtained by the recognition processing, to determine the existence of danger. However, an embodiment is conceivable in which there is no sensor-incorporating apparatus 200 performing the recognition processing, the sensor information is acquired by an information processing device 102 from a previously installed sensor so that the recognition processing is performed. Thus Embodiment 2 is described in which the sensor information detected by the sensor is directly acquired by an information processing device 102.

Figure 23:
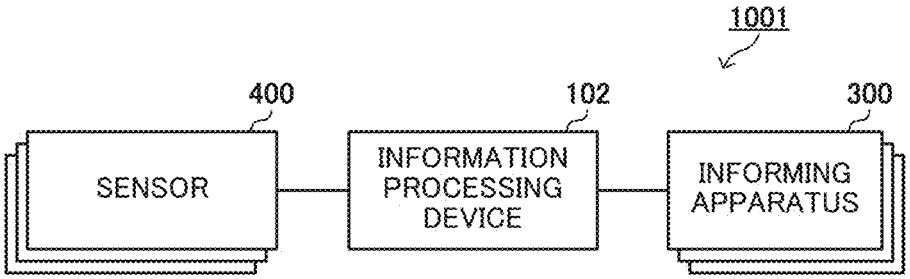
FIG. 23 illustrates an example of a system configuration of an informing system according to Embodiment 2 of the present disclosure.

An informing system 1001 according to Embodiment 2 of the present disclosure, as illustrated in FIG. 23, is equipped with the information processing device 102, at least one sensor 400, and at least one informing apparatus 300. However, the sensor 400 may be a sensor 400 that is independent of the sensor-incorporating apparatus 200, or may be a sensor that included in the sensor 62 of the sensor-incorporating apparatus 200 and that is capable of direct external output of the sensor information.

The information processing device 102 acquires from the sensor 400 the sensor information detected by the sensor 400, and recognizes the information of the shape and position of the object and living body on the basis of the acquired sensor information. Then on the basis of the recognized and obtained recognition information, determination is made as to whether the danger state exists. Then in the case that the determination is that the danger state exists, the information processing device 102 generates the informing signal to cause operation of the informing function of the informing apparatus 300, and transmits to the informing apparatus 300 the generated informing signal.

The sensor 400 detects information in accordance with the type of the sensor 400. Then the detected information is transmitted as sensor information to the information processing device 102. The sensor 400 may transmit to the information processing device 102 the sensor information every time that information is sensed, or the sensor information may be transmitted to the information processing device 102 in response to a request from the information processing device 102.

The informing apparatus 300 is the same as that of Embodiment 1, and thus further description is omitted. Moreover, in the same manner as in Embodiment 1, the information processing device 102 may be interconnected with the sensor 400 and the informing apparatus 300 by a freely-selected interface, and communication interfaces may be mixedly used.

Figure 24:
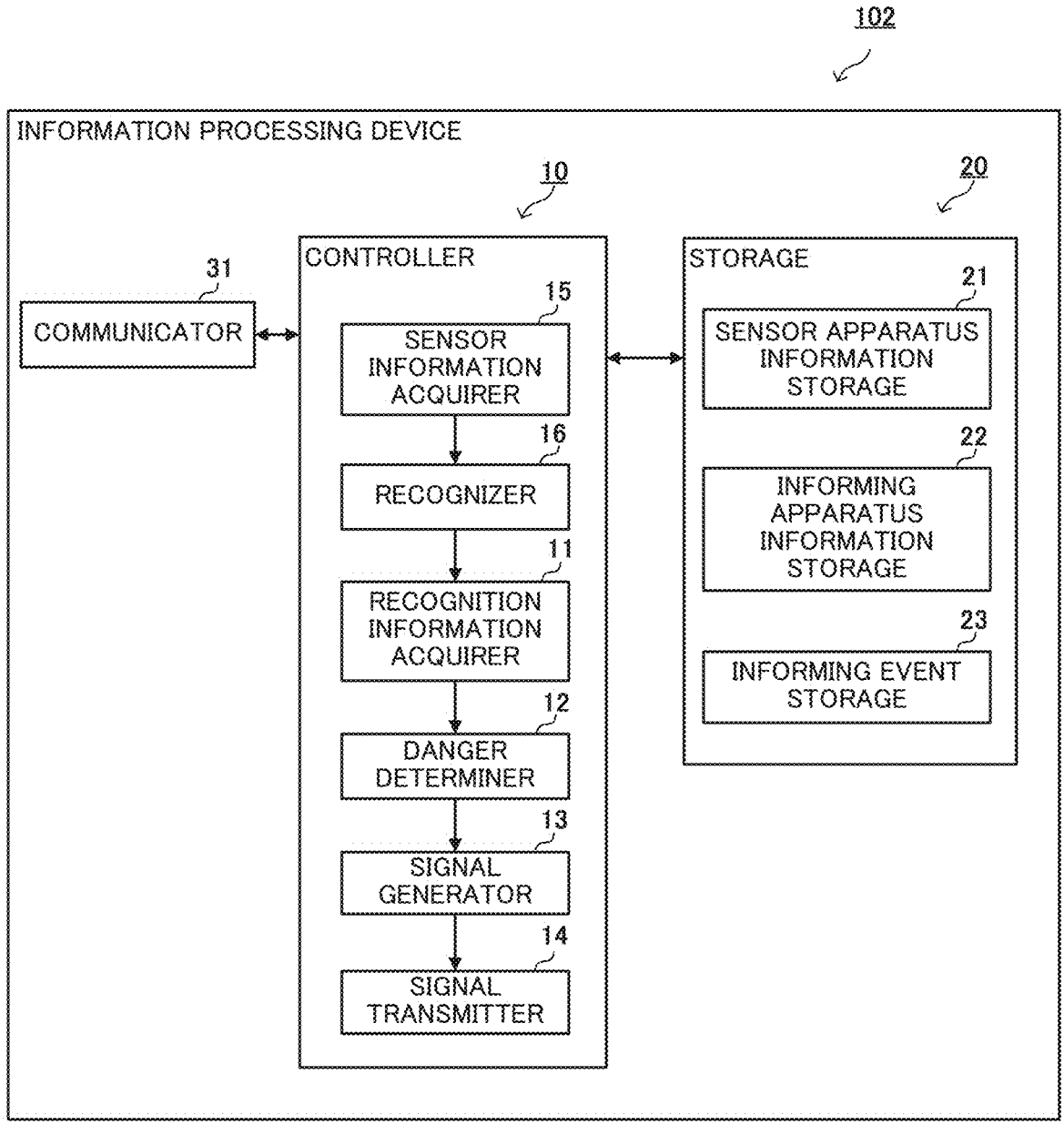
FIG. 24 is a function block diagram of an information processing device according to Embodiment 2.

As illustrated in FIG. 24, the functional configuration of the information processing device 102 includes the controller 10, the storage 20, and the communicator 31. The points of difference relative to the information processing device 100 are as follows: a sensor information acquirer 15 and a recognizer 16 are added to the controller 10; the recognition information acquirer 11 acquires recognition information obtained as a result of the recognizer 16 recognizing the sensor information, and that in the stored content of the sensor apparatus information storage 21, the "sensor apparatus name" becomes the "sensor name" and the "transmit recognition information" becomes the "sensor type".

The sensor information acquirer 15 acquires, from the sensor 400 via the communicator 31, the sensor information that is detected and output by the sensor 400. The recognizer 16 recognizes the sensor information acquired by the sensor information acquirer 15 and obtains the recognition information. For example, if the sensor 400 is an image sensor, the recognizer 16 recognizes the shape and position of the object and living body, and stores, in the storage 20 as the recognition information, the information on the shape and position of the object and the living body that are the information obtained as a result of the recognition. The functions of the recognizer 16 are the same as the functions of the recognizer 43 of the sensor-incorporating apparatus 200 of Embodiment 1.

The "sensor name" stored in the sensor apparatus information storage 21 is the name of the sensor 400, and the "sensor type" is the type of the sensor 400. The information processing device 102 can understand, according to the "sensor type", the type of the sensor information detected by the sensor 400.

The informing event storage 23 is similar to that of Embodiment 1, although the informing event storage 23 can increase the type of the informing events in accordance with the types of the sensors 400 connected to the information processing device 102. For example, in a case in which a thermopile type infrared radiation sensor is connected to the information processing device 102, a data example of sensor apparatus information storage 21 is illustrated in FIG. 25, and a data example of informing event storage 23 is illustrated in FIG. 26. The thermopile type infrared radiation sensor uses a sensor element termed a "thermopile" that connects multiple thermocouples, and thus is a sensor capable of detecting an object at a high temperature. The third row informing event of FIG. 26 is set for use of the information from this sensor to inform the adjacent user of danger when distance between the person and a high temperature part is less than or equal to a standard distance threshold. Furthermore, the distance between the person and the high temperature part is a minimum distance between the part capable of determination as the person and the part capable of determination as the high temperature part.

Figure 27:
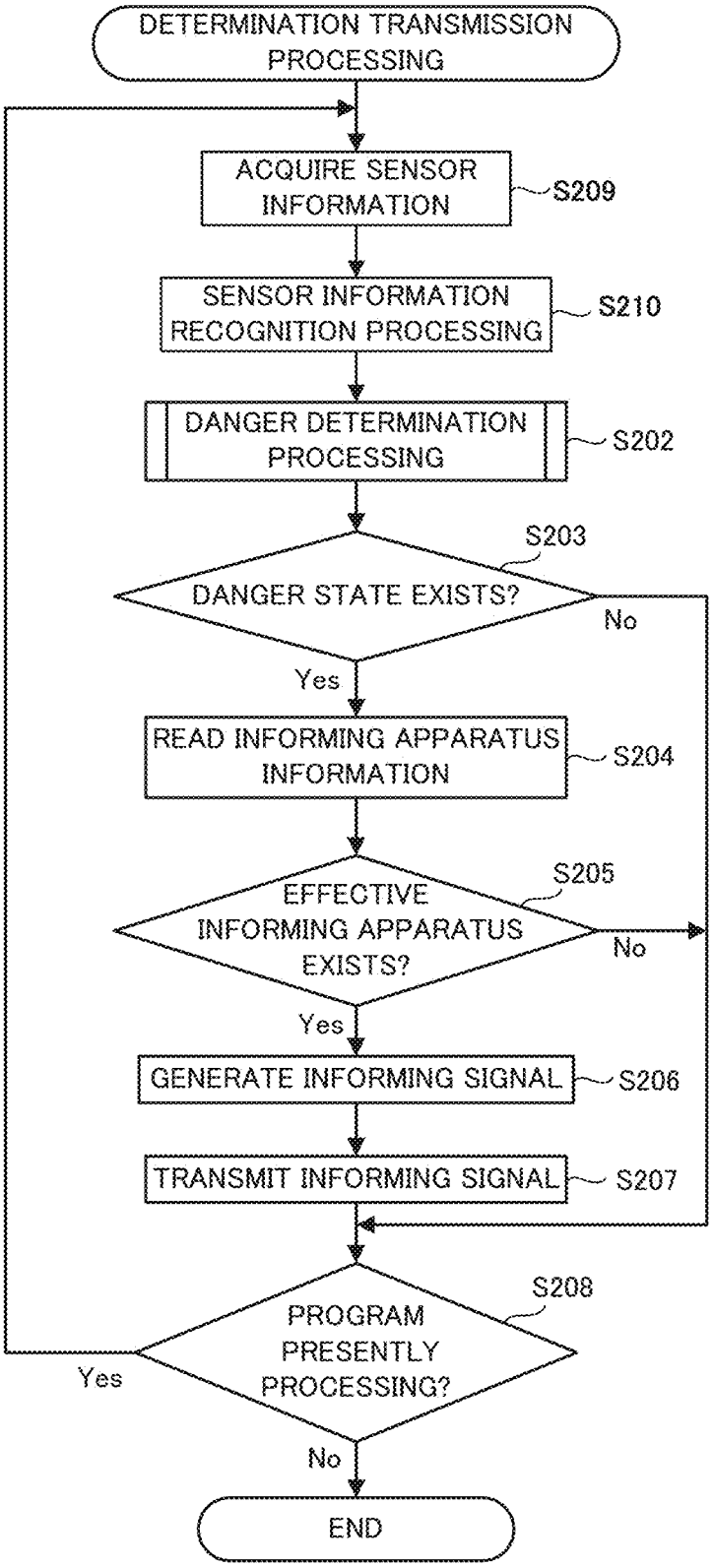
FIG. 27 is a flowchart of determination transmission processing of the information processing device according to Embodiment 2.

The determination transmission processing performed by the information processing device 102 is described next with reference to FIG. 27. Except for a portion of the determination transmission processing, this determination transmission processing is processing in common with the determination transmission processing performed by the information processing device 100 illustrated in FIG. 14, and thus only points of difference are described.

Firstly, the sensor information acquirer 15 acquires from the sensor 400 the sensor information (step S209). Then the recognizer 16 performs the recognition processing on the basis of the sensor information acquired by the sensor information acquirer 15 (step S210). This recognition processing depending on each of the sensors is performed on the basis of the information of the "sensor type" of the sensor apparatus information storage 21. Moreover, the recognition processing may be performed using the sensor information from multiple connected sensors 400 in an integrated manner. Then the recognition information acquirer 11 acquires the recognition information that is the information acquired as a result of recognition processing by the recognizer 16. The processing thereafter of step S202 and beyond is the same as that of the determination transmission processing performed by the information processing device 100 illustrated in FIG. 14, and thus further description of such processing is omitted.

Figure 16:
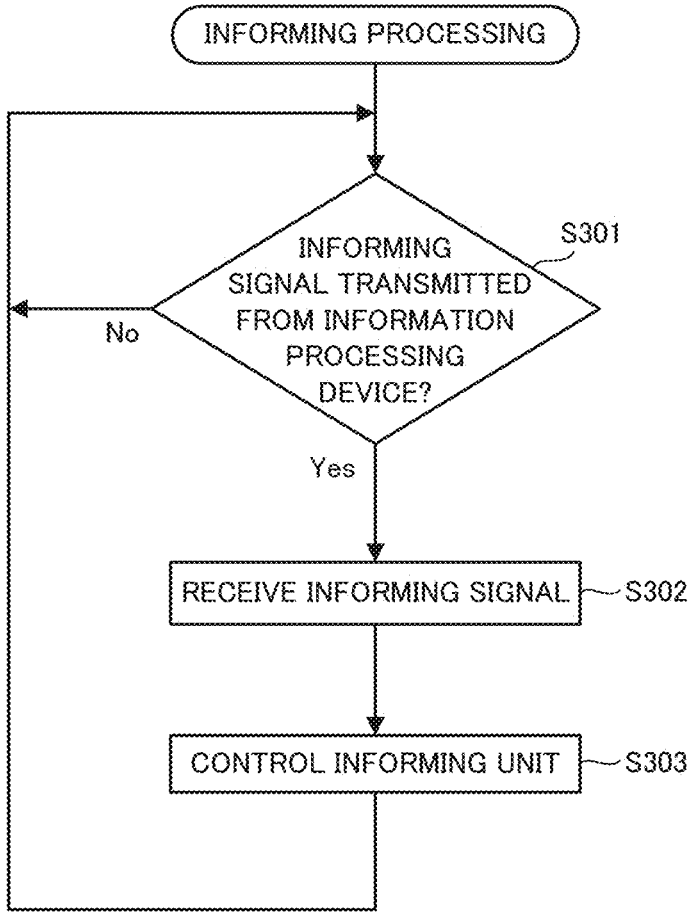
FIG. 16 is a flowchart of informing processing of the informing apparatus according to Embodiment 1.

Moreover, the informing processing performed by the informing apparatus 300 is also the same as the processing of FIG. 16 described in Embodiment 1, and thus further description of such processing is omitted.

As an example of use of sensor information from multiple sensors 400 in an integrated manner, the sensors 400 are described in a case in which an image sensor and a microwave Doppler radar sensor are included. Although the image sensor can solely recognize the size and position of a person, in the case in which a dummy having an exactly human shape is placed in the room, for example, a possibility exists that the use of only the image sensor could cause the controller to recognize the dummy as a person. In this case, by the microwave Doppler sensor detecting vibration of an object that is recognized by the image sensor to be a person, determination can be made that the object is a person if vibration exists, and that the object is a dummy if vibration does not exist. Such determination ability is due to the occurrence of vibration due to respiration and heart beat if the object is a person. Moreover, if the size and position of the person is recognized by the image sensor, then accuracy of the detection of respiration or heart beat can be further increased by performing the detection of the biological information by the microwave Doppler sensor directed toward the recognized position.

By the aforementioned processing, the information processing device 102 directly acquires the sensor information from the sensor 400, determines that the danger state exists on the basis of the recognition of the sensor information, and can inform the adjacent user of the occurrence of the danger state. That is to say, even in the case in which the informing system 1001 does not contain the sensor-incorporating apparatus 200 equipped with the recognizer 43 capable of being used for danger determination, the information processing device 102 can performs the recognition processing to determine whether the danger state exists, and can inform the adjacent user. Moreover, although each of the sensor-incorporating apparatuses 200 in Embodiment 1 can merely perform the recognition processing using only the sensor information of the sensor 62 with which each of the apparatuses itself is equipped, the information processing device 102 in Embodiment 2 is capable of performing the recognition processing by treating in an integrated manner the sensor information of all the connected sensors 400, and thus the danger determination processing can be performed with higher accuracy.

Moreover, the information processing device 102 can perform the recognition processing in accordance with the type of the connected sensor 400, and thus as described using FIGS. 25 and 26, for example, when the sensors 400 include a thermopile type infrared sensor, the recognizer 16 can recognize the high temperature part having high temperature on the basis of the sensor information from this infrared radiation sensor.

The "high temperature part" in the determination condition illustrated in FIG. 26 is mainly a part for which there is danger of burn injury. For example, the "high temperature part" may be determined to be a "part having a temperature of 80° C. or higher". This is an example of setting a standard temperature threshold to 80° C. Furthermore, conditions may be changed in accordance with temperature, and the determination condition may be set in accordance with multiple thresholds. For example, the determination condition may be set such that: in the case of a temperature of at least 80° C. and less than 100° C., an approach within 0.5 m may be determined to be "approaching a high temperature part"; and, in the case of a temperature greater than or equal to 100° C., an approach within 1 m may be determined to be "approaching the high temperature part". Moreover, the information event according to the temperature information is not necessarily limited to the "approaching high temperature part" illustrated in FIG. 26. For example "warning of heat stroke" may be set as an informing event using a determination condition that "wall or floor temperature is greater than or equal to 30° C.". When the occurrence of the danger state is determined on the basis of just the condition of the object or the location as in this example, the condition of the positional relationship between the object or the location and the person may be omitted from the determination condition.

In the case in which the temperature information is included in the sensor information, by setting of the informing event to which the temperature information is further added, the informing system 1001 can inform of the existence of a variety of danger states related to temperature, such as burn injury or heat stroke in addition to informing concerning just falling, and thus increased severity of injury can be prevented.

Modified Example of Embodiment 2

In the aforementioned embodiment, the content provided to inform the adjacent user is content set in the informing apparatus information storage 22 for every informing apparatus 300. However, the informing apparatus 30X), the informing method, and the informing message may be changed in accordance with the informing event. In order to achieve this system, an "informing event" column is added to the informing apparatus information storage 22, and the informing apparatus 300, the informing method, and the informing message are set for every "informing event" stored in the informing event storage 23. Then in the case in which the informing event for which the determination condition is satisfied matches an informing event set in the "informing event" column of the informing apparatus information storage 22, the adjacent user may be informed of the existence of danger by the informing apparatus 300, the informing method, and the informing message corresponding to the row of such matching. Due to configuration in this manner, the adjacent user can be informed more reliably as to what type of danger state exists.

Embodiment 3

An embodiment that intermixes the aforementioned Embodiment 1 and Embodiment 2 can be considered, and thus Embodiment 3 is described as a mixture of Embodiment 1 and Embodiment 2.

Figure 28:
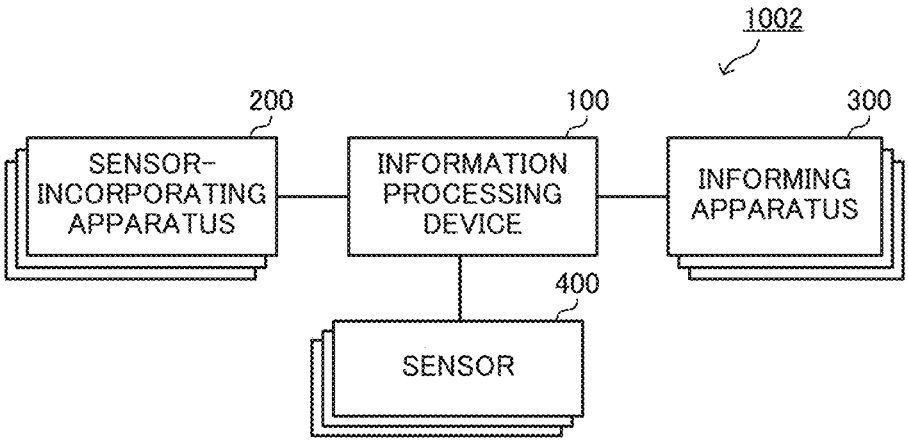
FIG. 28 illustrates an example of system configuration of an informing system according to Embodiment 3 of the present disclosure.

As illustrated in FIG. 28, an informing system 1002 according to Embodiment 3 of the present disclosure is equipped with an information processing device 103, at least one sensor-incorporating apparatus 200, at least one sensor 400, and at least one informing apparatus 300.

The information processing device 103 receives from the sensor-incorporating apparatus 200 the recognition information that is a result of recognition of the sensor information by the sensor-incorporating apparatus 200, and determines whether the danger state exists on the basis of the received recognition information. Also, the information processing device 103 receives the sensor information from the sensor 400, recognizes the information of the shape and location of the object and living body on the basis of the received sensor information, and determines whether the danger state exists on the basis of the recognition information obtained as a result of the recognition. Then in the case of determination that the danger state exists, the information processing device 103 generates the informing signal that causes operation of the informing function of the informing apparatus 300, and transmits this informing signal to the informing apparatus 300.

Device configurations other than the information processing device 103 and communication interfaces are the same as those in Embodiment 1 and Embodiment 2, and thus description of such device configurations and communication interfaces is omitted.

Figure 29:
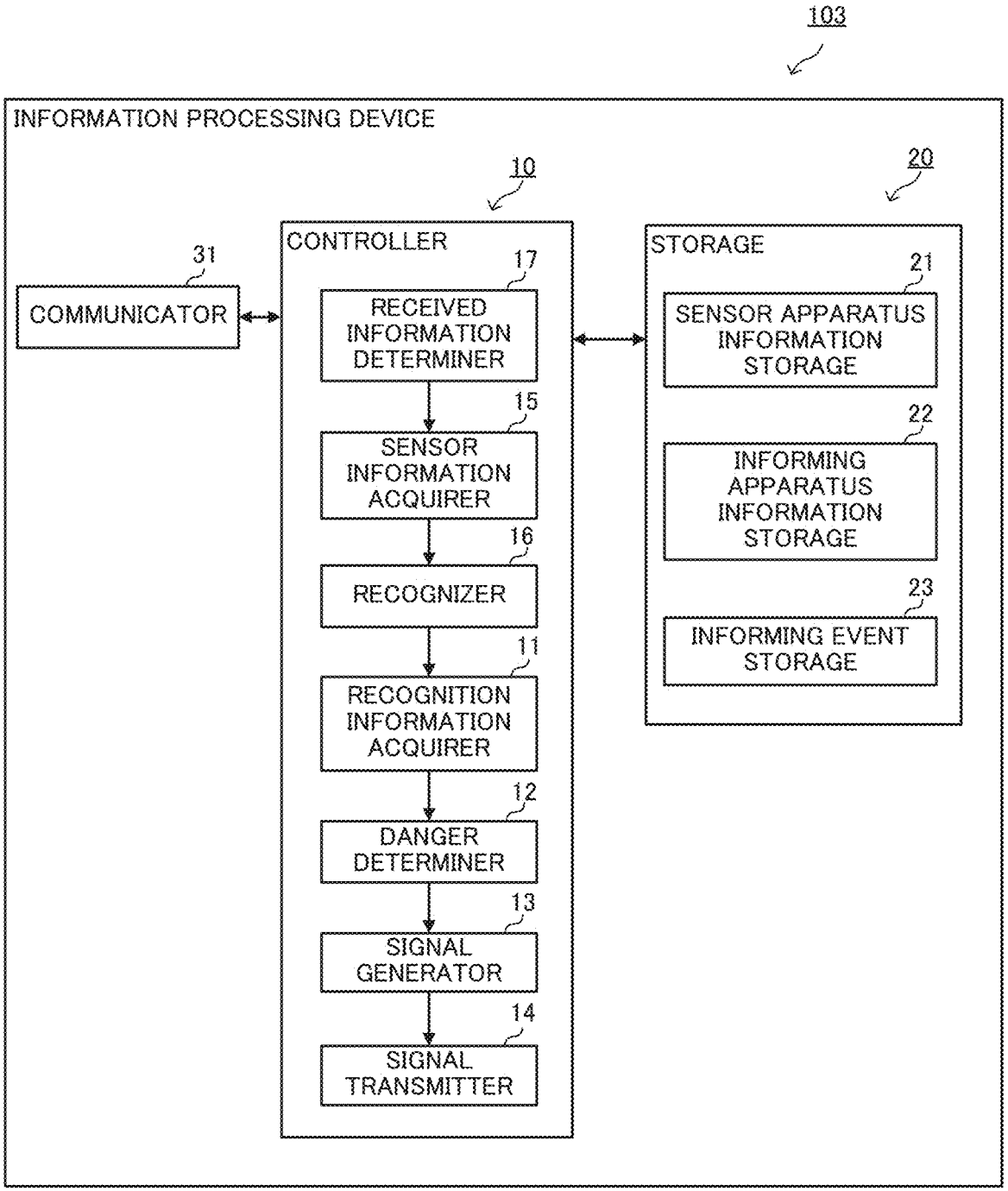
FIG. 29 is a function block diagram of an information processing device according to Embodiment 3.

As illustrated in FIG. 29, the information processing device 103 is functionally configured by being equipped with the controller 10, the storage 20, and the communicator 31. Points of difference from the information processing device 102 are: addition of a received information determiner 17 to the controller 10, the recognition information acquirer 11 acquiring both the recognition information from the sensor-incorporating apparatus 200 and the recognition information recognized by the recognizer 16, the "sensor name" stored content of the sensor apparatus information storage 21 being replaced with the "sensor apparatus name", and the "sensor type" stored content of the sensor apparatus information storage 21 being replaced with the "transmit sensor information".

The received information determiner 17 determines whether the information received via the communicator 31 is the recognition information from the sensor-incorporating apparatus 200 or the sensor information from the sensor 400.

As illustrated in FIG. 30, the sensor apparatus information storage 21 stores both information used in communication of the information processing device 103 with the sensor-incorporating apparatus 200 and information used in communication of the information processing device 103 with the sensor 400. The "sensor apparatus name" is the name of the sensor-incorporating apparatus 200 or the sensor 400. Further, the "transmit sensor information" is information that is transmitted from the sensor 400 or the sensor-incorporating apparatus 200 corresponding to the row of the "transmit sensor information", and indicates the type of the recognition information or sensor information. The information processing device 103, in accordance with the "transmitted sensor information" can know what type of information is received from the sensor-incorporating apparatus 200 or the sensor 400.

Figure 31:
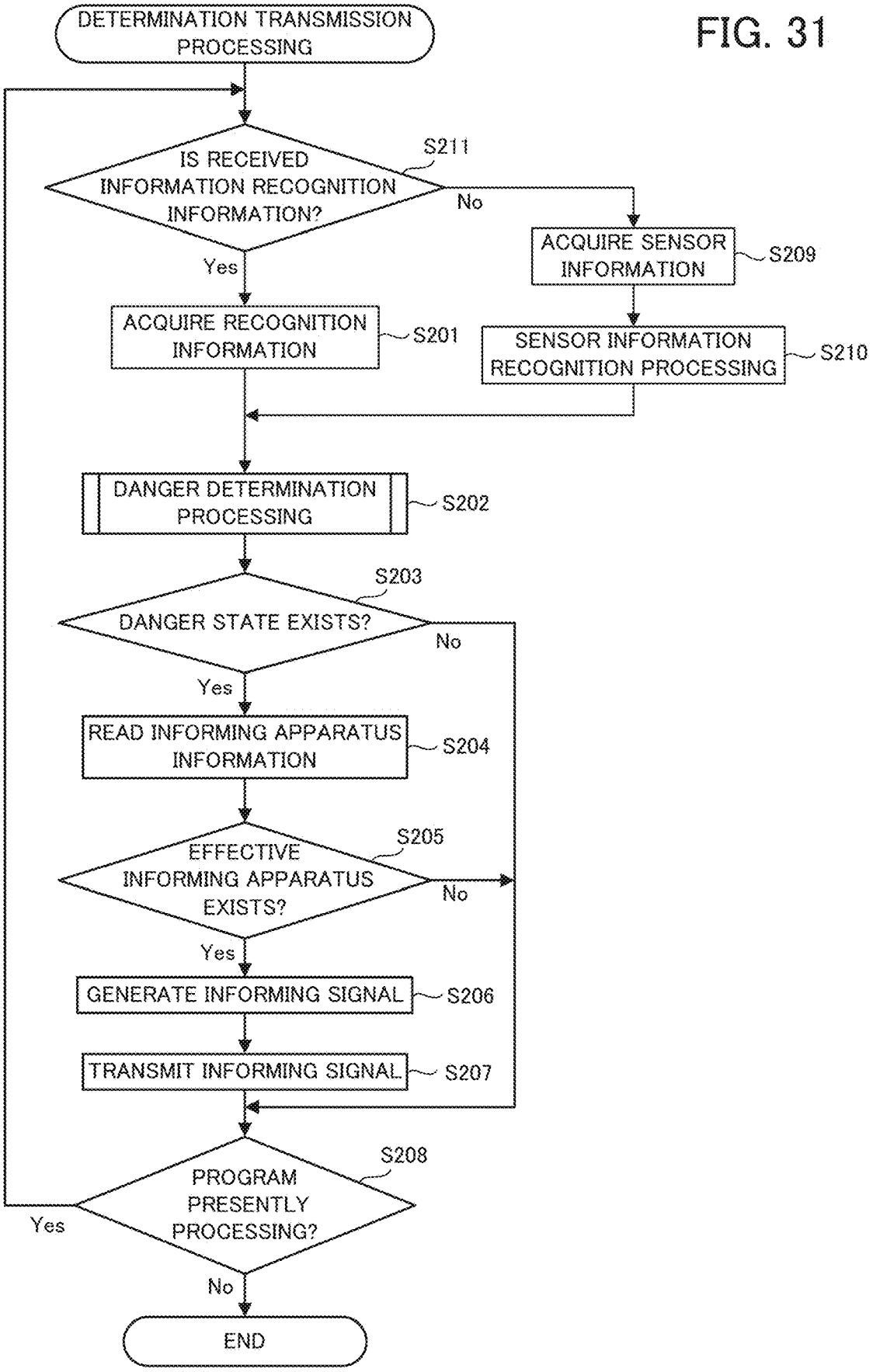
FIG. 31 is a flowchart of determination transmission processing of the information processing device according to Embodiment 3.

Next, the determination transmission processing performed by the information processing device 103 is described with reference to FIG. 31. This processing is processing in common with all but a part of the determination transmission processing performed by the information processing device 102 illustrated in FIG. 27, and thus only the points of difference are described below.

Firstly, the received information determiner 17 determines whether the information received via the communicator 31 from the sensor-incorporating apparatus 200 or the sensor 400 is the recognition information from the sensor-incorporating apparatus 200 (step S211). If the received information is such recognition information (YES in step S211), the recognition information acquirer 11 acquires the recognition information from the information received from the received information determiner 17 (step S201). If the received information is not such recognition information (NO in step S211), the sensor information acquirer 15 acquires the sensor information from the information received by the received information determiner 17 (step S209). The processing thereafter is the same as in the determination transmission processing performed by the information processing device 100 illustrated in FIG. 14 and the determination transmission processing performed by the information processing device 102 illustrated in FIG. 27, and thus further description of such processing is omitted.

Figure 12:
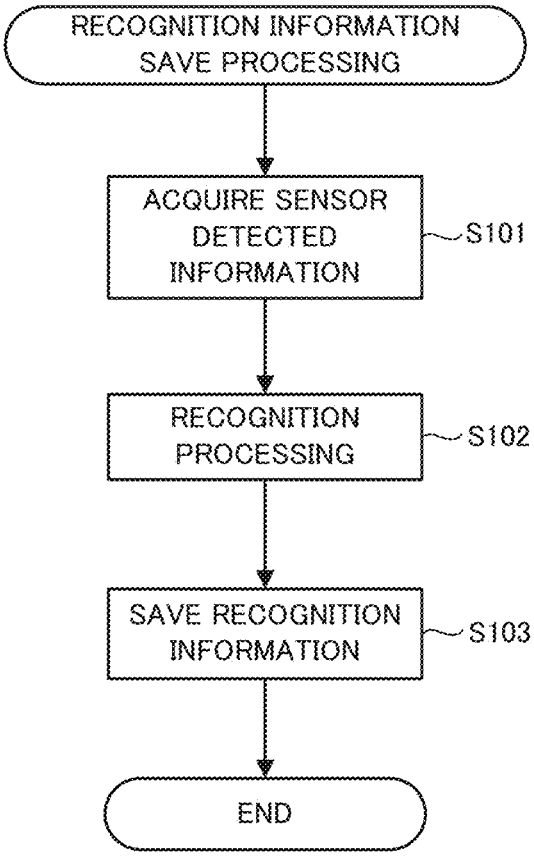
FIG. 12 is a flowchart of recognition information save processing of the sensor-incorporating apparatus according to Embodiment 1.
Figure 13:
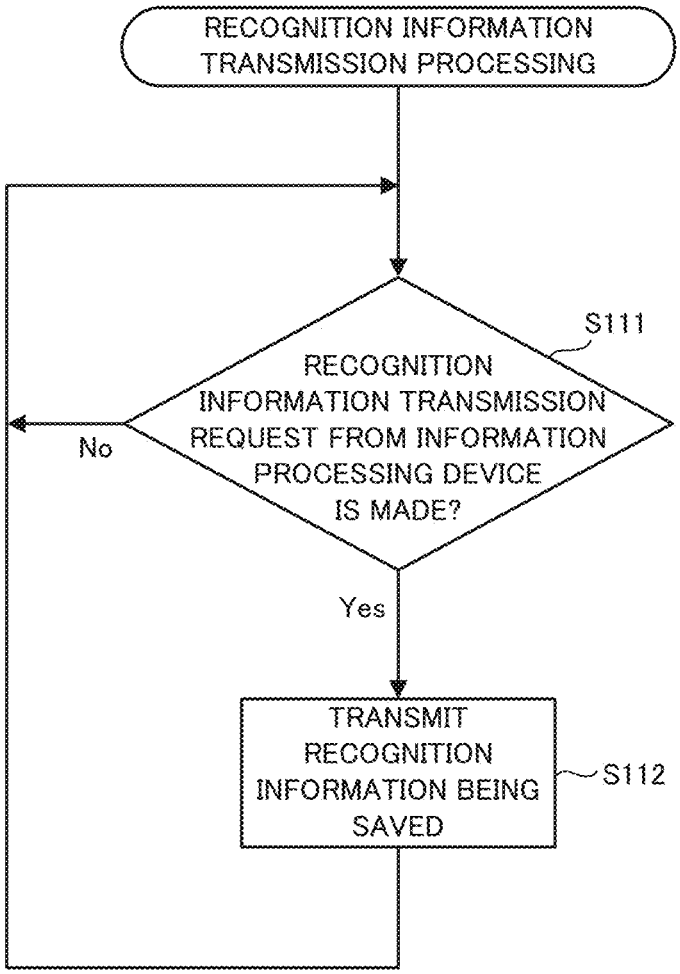
FIG. 13 is a flowchart of recognition information transmission processing of the sensor-incorporating apparatus according to Embodiment 1.

Moreover, the recognition information save processing and the recognition information transmission processing performed by the sensor-incorporating apparatus 200 and the informing processing performed by the informing apparatus 300 are the same as the processing of FIGS. 12 and 13 and the processing of FIG. 16 described in Embodiment 1, and further description of such processing is omitted.

Due to the aforementioned processing, the information processing device 103 can distinguish between the recognition information from the sensor-incorporating apparatus 200 and the sensor information from the sensor 400, and can acquire both such types of information. Thus recognition processing can be omitted for the information recognized by the sensor-incorporating apparatus 200. Moreover, when information is insufficient using (that is used for) the recognition processing of the sensor-incorporating apparatus 200 in processing to determine the existence of danger, the information processing device 103 itself, on the basis of the sensor information from the sensor 400, can perform the recognition processing required for determination of the existence of danger. Thus danger determination processing can be performed in a more flexible manner.

Furthermore, the aforementioned embodiments can be freely combined. For example, by combination of the first modified example of Embodiment 1 with Embodiment 2, when the danger state exists, control devices including the electrically-driven shutter can be controlled on the basis of the sensor information from the sensor 400. Moreover, by combination of the second modified example of Embodiment 1 with Embodiment 2, a rate of rise of temperature of the high temperature part and a rate of spreading of surface area of the high temperature part, for example, can be acquired, thereby enabling early detection and informing of a fire. Thus the fire can be extinguished at an earlier stage. Moreover, by combination of the modified example of Embodiment 2 with Embodiment 1, even when the informing system does not have the sensor 400, the informing apparatus 300, the informing means, and the informing message can be set for every informing event, and the adjacent user can be informed more accurately as to the type of the danger state.

Figure 32:
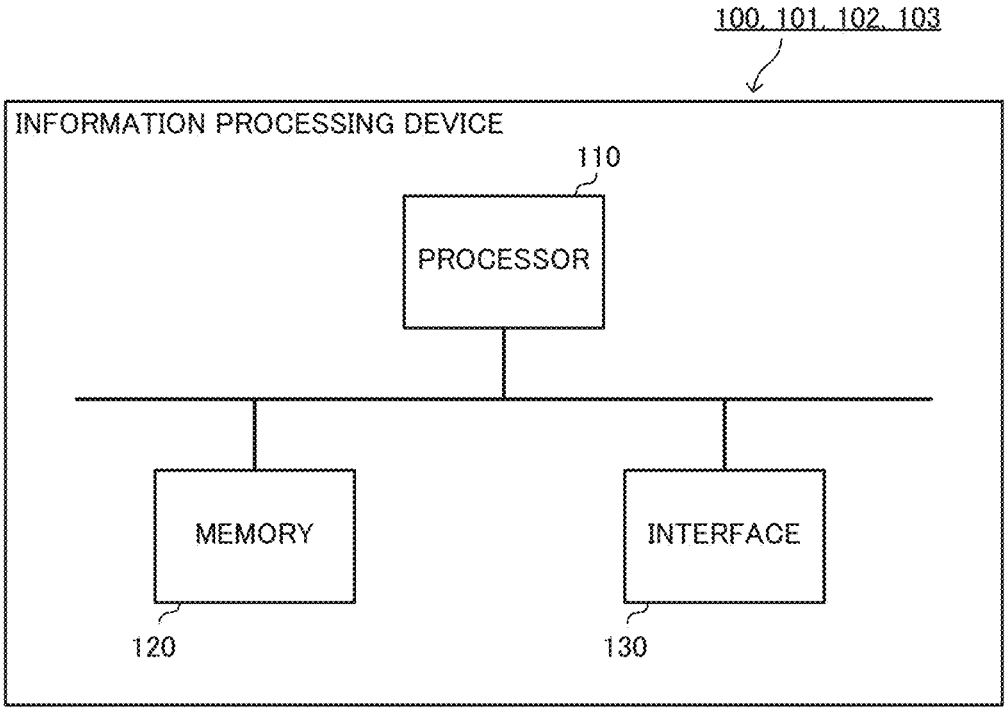
FIG. 32 illustrates an example of hardware configuration of the information processing device according to the present disclosure.

The hardware of the information processing devices 100, 101, 102, and 103 according to the embodiments of the present disclosure, as shorn in FIG. 32 for example, include the processor 110, the memory 120, and the interface 130. The functions of the information processing devices 100, 101, 102, and 103 can be achieved by the processor 110 executing programs stored in the memory 120. The interface 130 is used for connecting the information processing devices 100, 101, 102, and 103 with the sensor-incorporating apparatus 200, the informing apparatus 300, and the sensor 400, and for establishing communication, and as may be required, the interface 130 can include multiple types of interfaces. Moreover, although FIG. 32 illustrates an example formed using the single processor 110 and the single memory 120, the aforementioned functions can be executed cooperatively by multiple processors and multiple memories.

Moreover, in each of the aforementioned embodiments, the various functions can be realized by a general computer. Specifically, in the aforementioned embodiments, programs executed by the controllers 10, 40, and 70 are described as stored beforehand in the ROM of the storages 20, 50, and 80. However, the programs may be stored in a computer-readable medium such as a flexible disc, a compact disc read only memory (CD-ROM), a digital versatile disc (DVD), and a magneto-optical (MO) disc to be delivered and distributed: and by reading such programs and installing such programs on the computer, the computer may be configured to enable achievement of the various functions described above. Furthermore, when each of the above-described functions is achieved by dividing the above-described functions among an operating system (OS) and an application or cooperatively with the OS and the application, the program other than the OS may be stored on a recording medium.

Furthermore, in each of the aforementioned embodiments, there is no need to equip the information processing devices 100, 101, 102, and 103 with part or all of the components included in the storage 20 (the sensor apparatus information storage 21, the informing apparatus information storage 22, the informing event storage 23, and the recognition record storage 24) is permissible, and such components may be acquired from another information processing device 10X), 101, 102, or 103, a memory device, or a cloud server connected via a communication network.

Furthermore, the programs may be superimposed onto a carrier wave for delivery of the programs via a communication network. For example, such programs may be posted on a bulletin board system (BBS) on a communication network, and may be distributed via the network. Furthermore, such programs may be started, and under the control of the OS, may be executed similarly to other application programs, thereby enabling execution of each of the aforementioned processing.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

INDUSTRIAL APPLICABILITY

The present disclosure can be used advantageously for an information processing device, an informing system, an information processing method, and a program for determining whether a danger state exists.

REFERENCE SIGNS LIST

10, 40, 70 Controller
11 Recognition information acquirer
12 Danger determiner
13 Signal generator
14 Signal transmitter
15 Sensor information acquirer
16, 43 Recognizer
17 Received information determiner
20, 50, 80 Storage
21 Sensor apparatus information storage
22 Informing apparatus information storage
23 Informing event storage
24 Recognition record storage
31, 61, 91 Communicator
41, 71 Main function controller
42 Sensor information acquirer
44 Recognition information transmitter
62 Sensor
63, 93 Main function unit
72 Informing signal receiver
73 Informing controller
92 Informing unit
100, 101, 102, 103 Information processing device
110 Processor
120 Memory
130 Interface
200 Sensor-incorporating apparatus
300 Informing apparatus
400 Sensor
1000, 1001, 1002 Informing system

The invention claimed is:

1. An information processing device comprising:

a recognition information acquirer to acquire, from an electric apparatus that performs operational control using sensor information, recognition information that is information obtained as a result of recognition of the sensor information by the electric apparatus and comprises position information on a target of recognition and position information on a person, the sensor information being sensed and output by a sensor;

a danger determiner to determine that the person included in the recognition information is in a danger state in a case in which a relationship between the position of the target of recognition and the position of the person satisfies a determination condition, the target of recognition and the person being included in the recognition information acquired by the recognition information acquirer;

a signal generator to, upon the danger determiner determining that the person included in the recognition information is in the danger state, determine whether at least one informing apparatus exists which is presently effective for communication and generate an informing signal that causes operation of an informing function of the at least one informing apparatus determined to exist and be presently effective that informs that the person included in the recognition information is in the danger state; and a signal transmitter to transmit to the at least one informing apparatus the informing signal generated by the signal generator.

2. The information processing device according to claim 1, further comprising:

a sensor information acquirer to acquire the sensor information sensed and output by the sensor; and a recognizer to recognize the sensor information acquired by the sensor information acquirer, wherein the recognition information acquirer acquires the recognition information that is information obtained as a result of recognition by the recognizer.

3. The information processing device according to claim 1, wherein the target of recognition has an opening that is a part opened in a portion of a wall, and when a distance between the opening and the person is less than or equal to a standard distance threshold, the danger determiner determines that the danger state exists.

4. The information processing device according to claim 1, wherein the target of recognition has a level difference that is a part where a height difference exists in a floor, and when a distance between the level difference and the person is less than or equal to a standard distance threshold, the danger determiner determines that the danger state exists.

5. The information processing device according to claim 3, wherein the recognition information comprises: (i) position information on a center of a room, (ii) position information on an opening that is a part opened in a portion of a wall of the room, and (iii) the position information on the person, and the danger determiner determines that the danger state exists when a distance from the center of the room to the person is greater than a distance from the center of the room to the opening and an angular difference between a direction of the opening relative to the center of the room and a direction of the person relative to the center of the room is less than or equal to a standard directional threshold.

6. The information processing device according to claim 4, wherein the recognition information comprises (i) position information on a level difference and information on a height of the level difference, the level difference being a part where a height difference exists in a floor, (ii) position information on a person, and (iii) information on a height of a center of mass of the person, and the danger determiner determines that the danger state exists when the height of the center of mass of the person is lower than a height of a part of the level difference having maximum height and a distance between the level difference and the person is less than or equal to a standard distance threshold.

7. The information processing device according to claim 1, wherein the target of recognition has a high temperature part that is a part causing a risk of a burn injury, and the danger determiner determines that the danger state exists when a distance between the high temperature part and the person is less than or equal to a standard distance threshold.

8. An informing system comprising:

the information processing device according to claim 1;

an electric apparatus to transmit to the information processing device recognition information that is information obtained as a result of recognition of the sensor information sensed and output by the sensor; and an informing apparatus having a function for informing of information based on at least one of visual information, audio information, or tactile information, wherein the recognition information acquirer of the information processing device acquires the recognition information transmitted by the electric apparatus, and the informing apparatus informs of danger in accordance with the informing signal transmitted by the signal transmitter of the information processing device.

9. The information processing device according to claim 1, wherein the recognition information comprises information on an age of the person, and the danger determiner determines, based on the information on the age, that the person is in the danger state in a case in which the person is presumed to be a child.

10. The information processing device according to claim 1, wherein the recognition information comprises information on a height of the person, and the danger determiner determines, based on the information on the height, that the person is in the danger state in a case in which the person is presumed to be a child.

11. The information processing device according to claim 1, wherein the recognition information comprises information on a body temperature of the person, and the danger determiner determines, based on the information on the body temperature, that the person is in the danger state in a case in which the person is presumed to be a child.

12. The information processing device according to claim 1, wherein the recognition information comprises information on an age of the person, and the danger determiner determines, based on the information on the age, that the person is in the danger state in a case in which the person is presumed to be an elderly person.

13. The information processing device according to claim 1, wherein the recognition information comprises information on a body temperature of the person, and the danger determiner determines, based on the information on the body temperature, that the person is in the danger state in a case in which the person is presumed to be an elderly person.

14. The information processing device according to claim 4, wherein the recognition information comprises information on a height of the person, and the danger determiner determines whether the person is in the danger state based on a comparison between a height of the level difference and the height of the person.

15. An information processing method for an information processing device comprising:

acquiring, from an electric apparatus that performs operational control using sensor information, recognition information that is information obtained as a result of recognition of the sensor information sensed and output by a sensor and comprises position information on a target of recognition and position information on a person;

determining that the person included in the recognition information is in a danger state in a case in which a relationship between the position of the target of recognition and the position of the person satisfies a determination condition, the target of recognition and the person being included in the acquired recognition information; and upon determination that the person included in the recognition information is in the danger state, determining whether at least one informing apparatus exists which is presently effective for communication and generating an informing signal that causes operation of an informing function of the at least one informing apparatus determined to exist and be presently effective that informs that the person included in the recognition information is in the danger state, and transmitting, by a signal transmitter, the informing signal to the at least one informing apparatus.

16. A non-transitory computer-readable recording medium storing a program for causing a computer to execute:

a danger determining step of determining that a person included in recognition information is in a danger state in a case in which a relationship between a position of a target of recognition and a position of the person satisfies a determination condition, the recognition information being information obtained as a result of recognition of sensor information sensed and output by a sensor, the recognition information comprising information on the position of the target of recognition and information on the position of the person; and a signal transmitting step of, upon determination in the danger determining step that the person included in the recognition information is in the danger state, (i) determining whether at least one informing apparatus exists which is presently effective for communication, (ii) generating an informing signal that causes operation of an informing function of the at least one informing apparatus determined to exist and be presently effective that informs that the person included in the recognition information is in the danger state, and (iii) transmitting the informing signal to the at least one informing apparatus.

17. An information processing device comprising:

a recognition information acquirer to acquire, from an electric apparatus that performs operational control using sensor information, recognition information that is information obtained as a result of recognition of the sensor information by the electric apparatus, the sensor information being sensed and output by a sensor;

a danger determiner to determine whether a person included in the recognition information is in a danger state based on the recognition information acquired by the recognition information acquirer;

a signal generator to, upon the danger determiner determining that the person included in the recognition information is in the danger state, determine whether at least one informing apparatus exists which is presently effective for communication and generate an informing signal that causes operation of an informing function of the at least one informing apparatus determined to exist and be presently effective that informs that the person included in the recognition information is in the danger state; and a signal transmitter to transmit, to the at least one informing apparatus carried by a user around the person included in the recognition information, the informing signal generated by the signal generator.

18. An information processing device comprising:

a recognition information acquirer to acquire, from an electric apparatus that performs operational control using sensor information, recognition information that is information obtained as a result of recognition of the sensor information by the electric apparatus and comprises information on temperatures of and information on positions of targets of recognition, the sensor information being sensed and output by a sensor;

a danger determiner to determine whether a temperature of a wall or a floor among the targets of recognition is equal to or greater than a standard temperature threshold;

a signal generator to, upon the danger determiner determining that the temperature of the wall or the floor is equal to or greater than the standard temperature threshold, determine whether at least one informing apparatus exists which is presently effective for communication and generate an informing signal that causes operation of an informing function of the at least one informing apparatus determined to exist and be presently effective that informs that there is a risk of heatstroke; and a signal transmitter to transmit, to the at least one informing apparatus, the informing signal generated by the signal generator.

19. An information processing device comprising:

a recognition information acquirer to acquire, from an electric apparatus that performs operational control using sensor information, recognition information that is information obtained as a result of recognition of the sensor information by the electric apparatus and comprises information on a temperature of and position information on a target of recognition, the sensor information being sensed and output by a sensor;

a danger determiner to determine presence or absence of a rise in a temperature of a high temperature part of the target of recognition and presence or absence of an expansion of a surface area of the high temperature part;

a signal generator to, upon the danger determiner determining that there occur the rise in the temperature of the high temperature part and the expansion of the surface area of the high temperature part, determined whether at least one informing apparatus exists which is presently effective for communication and generate an informing signal that causes operation of an informing function of the at least one informing apparatus determined to exist and be presently effective that informs that a fire breaks out; and a signal transmitter to transmit, to the at least one informing apparatus, the informing signal generated by the signal generator.

* * * * *